US006808256B2

(12) United States Patent
Umeyama et al.

(10) Patent No.: US 6,808,256 B2
(45) Date of Patent: Oct. 26, 2004

(54) SEALING MEMBER, CONNECTING STRUCTURE USING SEALING MEMBER, AND LIQUID DISCHARGE RECORDING HEAD

(75) Inventors: Mikiya Umeyama, Tokyo (JP); Yutaka Koizumi, Kanagawa (JP); Yukuo Yamaguchi, Tokyo (JP); Takeshi Yamakubo, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 2 days.

(21) Appl. No.: 10/364,317

(22) Filed: Feb. 12, 2003

(65) Prior Publication Data

US 2003/0156174 A1 Aug. 21, 2003

(30) Foreign Application Priority Data

Feb. 15, 2002 (JP) ..... 2002-039244

(51) Int. Cl.[7] ..... B41J 2/175
(52) U.S. Cl. ..... 347/87
(58) Field of Search ..... 347/85, 86, 87; 604/256

(56) References Cited

U.S. PATENT DOCUMENTS

| | | | | |
|---|---|---|---|---|
| 4,896,172 A | | 1/1990 | Nozawa et al. | 347/17 |
| 4,908,636 A | | 3/1990 | Saito et al. | 347/25 |
| 5,231,424 A | | 7/1993 | Kaneko et al. | 347/29 |
| 5,457,485 A | | 10/1995 | Moriyama et al. | 347/92 |
| 5,561,448 A | | 10/1996 | Kaneko et al. | 347/29 |
| 5,589,862 A | * | 12/1996 | Ujita et al. | 347/87 |
| 5,680,164 A | * | 10/1997 | Miller et al. | 347/87 |
| 5,815,183 A | * | 9/1998 | Sasaki | 347/86 |
| 6,000,792 A | | 12/1999 | Koizumi et al. | 347/89 |
| 6,059,403 A | * | 5/2000 | Burgin | 347/87 |
| 6,145,975 A | * | 11/2000 | Kotaki et al. | 347/87 |
| 6,412,911 B1 | * | 7/2002 | Hilton et al. | 347/49 |
| 6,431,681 B2 | | 8/2002 | Hatasa et al. | 347/19 |
| 6,631,982 B2 | | 10/2003 | Sasaki et al. | 347/85 |
| 6,666,550 B2 | * | 12/2003 | Sasaki | 347/85 |
| 2002/0118263 A1 | | 8/2002 | Watanabe et al. | 347/86 |
| 2002/0140789 A1 | | 10/2002 | Tajima et al. | 347/87 |
| 2003/0007046 A1 | | 1/2003 | Asano et al. | 347/86 |
| 2003/0025773 A1 | | 2/2003 | Koizumi et al. | 347/85 |

* cited by examiner

*Primary Examiner*—Anh T. N. Vo
(74) *Attorney, Agent, or Firm*—Fitzpatrick, Cella, Harper & Scinto

(57) ABSTRACT

A head chip and a recording liquid storing unit are bonded through a sealing member. The head chip comprises a recording element base plate, and a flow path formation member provided with a bonding face and a supply hole. The frame member of the recording liquid storing unit is formed by a single member, which is provided with a recording liquid storing chamber, one side face of which forms a totally open portion. The shape of the opening portion is equal to the sectional shape of the recording liquid storing chamber. For the flat portion of the sealing member, there are formed a hole portion, the circumferential first face-side ribs that surround it, and the second face-side ribs, which are exactly symmetrical to the first face-side ribs, with the flat portion between them. These ribs are compressed and held by both bonding faces. An inner extrusion of the rib on the flat portion is fitted into the position hole of the bonding face. Through the sealing member thus arranged, the recording liquid storing unit and the head chip are connected to simplify the connecting structure.

17 Claims, 15 Drawing Sheets

SEALING MEMBER, CONNECTING STRUCTURE USING SEALING MEMBER, AND LIQUID DISCHARGE RECORDING HEAD

BACKGROUND OF THE INVENTION

1. Field of the Invention

The present invention relates to a sealing member residing inclusively between two members having opening portions, which enables the opening portions of such members to be communicated, while seals them from the outside, and a connecting structure provided with such sealing member. The invention also relates to a liquid discharge recording head that records by discharging recording liquid from discharge ports.

2. Related Background Art

The liquid discharge recording method (ink jet recording method), in which droplets of recording liquid (ink) or the like, are discharged from the discharge ports (orifices) of a liquid discharge recording head, is the so-called non-impact recording method that makes high-speed recording possible, and also, makes recording possible on various recording mediums with the advantage that noises are not practically generated at the time of recording. As a result, the liquid discharge recording apparatus that mounts the liquid discharge recording head is widely adopted as recording means for a printer, a word processor, facsimile equipment, a copying machine, and a mailing machine, among some others.

As the typical example of the liquid discharge recording head of the kind, there is one that uses electrothermal converting element for heating recording liquid to bubble, thus discharging liquid droplets from fine discharge ports to a recording medium for the execution of recording. Then, as the liquid discharge recording head, it is generally practiced to form a structure with the recording unit that forms liquid droplets, and the recording liquid storing unit that supplies recording liquid to the recording unit.

With reference to FIG. 17 and FIG. 18, the conventional liquid discharge recording head will be described. FIG. 17 is a partially broken perspective view that shows the recording unit of the conventional liquid discharge recording head. FIG. 18 is an exploded perspective view.

As shown in FIG. 18, the liquid discharge recording head is structured by bonding the recording unit 1140 and the recording liquid storing unit 1130.

As shown in FIG. 17, for the recording unit 1140, the recording element base plate 1107 provided with the recording element 1106 that serves as the energy generating member for discharging liquid is die bonded on the supporting base plate 1110, which is formed by aluminum, ceramics, or the like. On the recording element base plate 1107, there are provided shift registers for driving use, and wiring patterns, although not shown, besides the recording element 1106. These are incorporated together with the recording element 1106 on the recording element base plate 1107 in advance by use of the silicon formation technologies and techniques. To the recording element base plate 1107, the ceiling plate 1100 having pressed portions that become liquid flow paths 1103 and a liquid chamber 1104 is fixed by means of a flat spring 1105 or other pressure means or bonding means, such as bonding agent. In this manner, the liquid flow paths 1103 and common liquid chamber 1104 are partitioned. Further, the flow path formation member 1120 is arranged on the upper face of the ceiling plate 1100, which connected with the supply port 1122, thus supplying recording liquid to the common liquid chamber 1104 in the ceiling plate 1100. Inside the flow path formation member 1120, flow paths of recording liquid are formed, and a porous member 1121 is bonded in the flow paths on the side opposite to the bonding portion to the ceiling plate for trapping impurities contained in recording liquid. Also, an orifice plate 1101 is aligned and bonded to the end face of the ceiling plate 1100 and the recording element base plate 1107. The orifice plate 1101 is provided with fine discharge port groups (orifice groups) 1102 for discharging liquid droplets.

To the supporting base plate 1110, the wiring base plate 1108, which makes electric connection with the liquid discharge recording apparatus main body, is bonded besides the recording element base plate 1107. The recording element base plate 1107 and the wiring base plate 1108 are electrically connected by use of wire bonding, lead bonding, or the like. For the wiring base plate 1108, contact pads (not shown) are formed to electrically connect it with the liquid discharge recording apparatus main body.

On the other hand, as shown in FIG. 18, the recording liquid storing unit 1150 is provided with the frame member 1130 having a recording liquid storing chamber (not shown) that contains recording liquid therein, which serves as the housing to support the recording unit 1140. The frame member 1130 that forms the principal part of the recording liquid storing unit 1150 is structured with the frame member main body 1130*a* and the frame member cover 1130*b*. Then, the frame member cover 1130*b* is bonded to the frame member main body 1130*a* by means of ultrasonic welding or the like on the plane that faces the connecting portion of the recording unit 1140. In this way, the recording liquid storing chamber is formed inside the frame member 1130.

Then, the recording unit 1140 is positioned and fixed to the frame member 1130 by bonding means, such as screws 1131, bonding agent, or the like. There is provide a predetermined gap for the bonding portion between the frame member 1130 and the recording unit 1140, and the gap is completely closed by sealing applied with the sealant or bonding agent, which flows into the gap to be solidified in it.

In the liquid discharge recording head, recording liquid stored in the recording liquid storing chamber is supplied to the liquid flow paths 1103 through the flow path formation member 1120 and the ceiling member 1100.

Here, the liquid discharge recording head is in the mode in which a single recording element base plate 1107 is die-bonded to the supporting base plate 1110. However, there is another mode in which plural recording element base plates 1107 are die-bonded to the supporting base plate 1110. Also, there are the liquid discharge recording apparatus of the mode in which is mounted only one liquid discharge recording head having single recording element base plate 1107 assembled thereon, and the liquid discharge recording apparatus of the mode in which plural liquid discharge recording heads are mounted.

In the liquid discharge recording head that uses electrothermal converting element as the recording element 1106, the electrothermal converting element is provided inside the liquid flow path 1103, and then, when electric pluses carrying recording signals are applied thereto, thermal energy is given to recording liquid. With the phase changes of recording liquid at that time, recording liquid bubbles (film boiling occurs), and the bubbling pressure is utilized for discharging recording liquid droplets. Here, in the case of the liquid discharge recording head that uses electrothermal converting element as the recording element 1106, there are the method in which recording liquid is discharged in parallel to the recording element base plate 1107 having the electrothermal converting element is arranged therefor (that is, the edge shooter method: see FIG. 17), and the method in which recording liquid is discharged vertically to the recording element base plate having the electrothermal converting element arranged therefor (that is, the side shooter method: not shown).

Also, FIG. 19 is an exploded perspective view that shows the other conventional liquid discharge recording head. The frame member 2202 of the liquid discharge recording head that forms the principal part of the recording storing unit thereof is structured by bonding the frame member main body 2201 and the frame member cover 2204 by ultrasonic welding after the insertion of the porous member 2203. Then, inside the frame member, a recording liquid storing chamber (not shown) is formed. To the surface of the frame member 2202 on the opposite side of the bonding face of the frame member cover of the frame member main body 2201, there is connected the recording unit 2100 that forms liquid droplets, and recording liquid can be supplied from the recording liquid storing unit to the recording unit 2100. More specifically, the cylindrical tube that extends from the recording unit 2100 is fitted into the opening portion of the frame member main body 2201, and then, on the circumference of the cylindrical tube, the rubber sealing member, which is so-called O-ring 2117 formed in an arc having a circular section, is arranged to effectuate connection, while securing the sealing capability.

SUMMARY OF THE INVENTION

In recent years, for the liquid discharge recording head, there have been in progress the higher discharge that increases discharge frequency per unit time and the multiple nozzle arrangement that increases the number of discharge nozzles (discharge ports) in order to obtain the higher recording performance, which makes it possible to provide highly precise recording at higher speed. Along with this, it is required to provide a countermeasure such as to increase the capacity and the sectional area of flow path corresponding to the increased amount of discharging liquid for the liquid flow path in the recording unit and the recording liquid storing chamber in the recording liquid storing unit, as well as in the portion that connects the recording unit with the recording liquid storing chamber. If the flow path sectional area is increased in the connecting portion, it is inevitable to make the closing mechanism larger, which should be provided on the circumference of the connecting portion in order to prevent the liquid leakage from or the mixture of the air in such portion.

On the other hand, the space saving and the cost reduction are required, and the need for downsizing of the liquid discharge recording head is more increasingly. Particularly, for the liquid discharge recording apparatus, for which plural liquid discharge recording heads are arranged for use, it is prerequisite that the liquid discharge recording head is made smaller and thinner in the arrangement direction thereof.

As in the case of the conventional liquid discharge recording head described earlier, where the connecting portion between the recording unit 2100 and the frame member 2202 of the recording liquid storing unit is sealed by the rubber sealing member, which is so-called the O ring 2117 (see FIG. 19), it is extremely difficult to cope with both making the sectional area of the connecting flow path larger along with the increased amount of discharge liquid, and making the liquid discharge recording head smaller and thinner simultaneously. In other words, the diameter of the O-ring 2117 should be made larger corresponding to the increased sectional area of the liquid flow path, which leads to making the liquid discharge recording head larger accordingly. Also, for this structure, the cylindrical tube is fitted into the opening portion as described earlier so as to prevent the leakage of recording liquid and the mixture of the air by the provision of the O-ring 2117, which is buried on the circumference of the cylindrical tube. In order to make the sealing capability thereof reliable, the inner circumference of the O-ring 2117 should be fit into the outer circumference of the cylindrical tube tightly, and the opening portion should be small enough so as to be clogged by the inner circumference of the O-ring 2117. The cylindrical tube and the O-ring 2117 should be manufactured in good precision, respectively, so that a precise work can be carried out in the assembling process.

Further, if the O-ring 2117 should be damaged or some foreign substance should be put between them unexpectedly due to some causes, such as variations in manufacturing steps for the structure in which the O-ring 2117 is used, sealant or bonding agent is not applied exactly to the circumference of the liquid flow path when the structure needs the application of sealant or bonding agent. As a result, the leakage of recording liquid and the mixture of the air take place take place in such imperfect portion to make it impossible to anticipate the performance as desired or to stain the interior of the liquid discharge recording apparatus main body eventually or in the worst case, short-circuit or the like is induced in the electric systems. Inversely, therefore, there is a need for manufacturing and assembling each of the components in extremely high precision.

On the other hand, in the case where the recording unit 1140 and the recording liquid storing unit 1150 are connected by sealant or bonding agent without using any sealing member (see FIG. 18), there is no need for making the size of the liquid discharge recording head larger considerably. However, there is a need for a time required for the sealing or bonding process, and a waiting time for keeping them in tact until sealant or bonding agent is solidified. As a result, work becomes complicated and the time required for completing work becomes longer. Also, the number of products on process (half-finished products on the way of manufacture) is increased, leading to the higher production costs. Also, the sealant or the bonding agent thus used tends to be fixed too strongly. Therefore, the dismantle work at the time of discarding the recording apparatus becomes inferior to the case where the sealing member is used. The bonded portion cannot be dislocated easily to make recycling inconvenient, hence presenting problem in terms of environmental protection.

For the aforesaid conventional liquid discharge recording head, the frame members 1130 and 2200 that form the principal part of the recording liquid storing unit are structured with two parts, the main body (frame member main body) 1130*a* and 2201, and the cover (frame member cover) 1130*b* and 2204. Now, the reasons are given below. For example, the structure shown in FIG. 19 that uses the O-ring 2117 needs the opening portion large enough to fit with the cylindrical tube of the recording unit 2100 for the frame member 2202 of the recording liquid storing unit. On the other hand, in order to retain the large amount of recording liquid as much as possible, almost entire body of the recording liquid storing unit is arranged to be the recording liquid storing chamber. As a result, the sectional area of the opening portion is, usually, made smaller than the sectional area of the recording liquid storing chamber. Then, it becomes necessary to arrange the drawing direction in the molding process to be opposite to the direction toward the opening portion, and in order to make drawing from the mold possible, the portion of the frame member 2201 on the side opposite to the opening portion should be arranged to open entirely after all. Then, in order to structure the recording liquid storing unit provided with the recording liquid storing chamber, the frame member cover 2204 is bonded to close the totally open surface of the frame member 2201 (the portion thereof on the side opposite to the opening portion). In this manner, the frame member 2202 is formed with the two members, the frame member main body 2201 and the frame member cover 2204. Also, for the structure shown in FIG. 18 that uses sealant or bonding agent, almost the entire body of the recording liquid storing unit 1150 is arranged to be the recording liquid storing chamber, and it is usually practiced to provide the opening portion, the sectional area of which is smaller the sectional area of the recording liquid storing chamber. Consequently, in the same way as described earlier, the frame member 1130 that forms the principal part of the recording liquid storing unit 1150 is formed by the two parts, the frame member main body 1130*a* and the frame member cover 1130*b*. The structures thus arranged present the drawbacks given below.

In other words, the frame member of the recording liquid storing unit should be made with plural parts, which makes it necessary to manufacture the respective parts by molding or the like, and bond them by use of ultrasonic welding or the like. This inevitably makes the production process complicated with increased numbers of half products, thus causing the production cost to be increased accordingly. Particularly, the recording liquid storing unit has the function to retain recording liquid in its interior. For that matter, there is a need for the complete prevention of the leakage of recording liquid to the outside, and the induction of the air outside into the interior thereof. Usually, when two parts are fused for bonding, the products with imperfect bonding are made in a certain probability as manufacturing errors unavoidably. Therefore, inspection is carried out after bonding to ascertain the bonding condition, and another process should be taken to remove defective products caused by such imperfect bonding. The addition of the inspection process results in the increase cost of production, and then, defective products are detected, the production cost of such products should be added to the final production costs, leading to a higher pricing of the finished product eventually. Also, the bonded part formed by plural components tends to be broken from the bonded portion, because stress is intensively given to the bonded portion if external shocks are added, thus making the strength of the bonded part weaker than the single part formed itself.

The problems that have been described above are caused by the structure of the frame member inevitably formed by two components, the frame member main body and the frame member cover due to the convenience of molding process, because the sectional area of the opening portion provided for the bonding portion of the recording liquid storing unit with the recording unit is smaller than the sectional area of the recording liquid storing chamber. Conventionally, there has been no structure in which the bonding portion of the recording unit is sealed exactly for the opening portion having the sectional area larger than the sectional area of the recording liquid storing chamber.

Now, therefore, the present invention is designed to aim at the provision of a sealing member capable of supplying recording liquid from the recording liquid storing unit, which is formed simpler than the conventional one, to the recording unit with a high sealing capability, and a connecting structure that contains such sealing member, as well as a liquid discharge recording head provided with such structure.

The present invention is characterized in that a sealing member, which exists inclusively between two members each provided with an opening portion for sealing both members from the outside, while enabling the opening portions of both members to be communicated, comprises a flat portion becoming the main body of the sealing member; a hole portion provided for the flat portion for enabling the opening portions of both members to be communicated; and ribs formed for both faces of the flat portion in the form of surrounding the hole portion and the opening portions of both members, and that the ribs of this sealing member include a first face-side rib formed on one face of the flat portion, and a second face-side rib formed on the other face of the flat portion in the symmetrical position and shape of the first face-side rib with the flat portion as the center. Here, it is preferable to provide the first face-side rib in plural number, and the second face-side rib also in the same number as that of the first face-side rib.

This sealing member is capable of sealing reliably with the ribs being smashed and deformed when being nipped by the two members. Particularly, with plural lines of ribs provided for one face, the reliability is enhanced significantly, because even if a part of ribs is made impossible to implement the sealing function due to some unexpected cause, the other ribs are able to implement the sealing function.

It may be possible to form each of the ribs to be essentially rectangular, and to be in a configuration to surround the opening portion. It may be possible to configure the rib to follow the outer shape of the flat portion. It is preferable to provide at least on one face of the flat portion a connecting portion for use of positioning on the inner side of the rib to effectuate positioning with respect to the member abutting against such face.

Another feature of the present invention is such that the connecting structure, which enables two members each provided with an opening portion to be communicated to make distribution of liquid possible, while sealing them from the outside, is provided with either one of the aforesaid sealing members that inclusively exists between both members, and for the portions of both of the members facing such sealing member, connecting faces each abutting the ribs, are provided on the outer side of each of the opening portions, and the sealing member is held so as to keep the ribs in a state of being compressed between the connecting faces themselves of both members.

With the structure thus arranged, it becomes possible to form simply and at lower costs the structure that enables two members to be communicated to make the distribution of liquid possible, while sealing them from the outside in addition to the effects that has been described earlier. Particularly, then, the configurations and sizes of the bonding face and opening portions of the two members can be freely selected to a considerable extent, and the freedom of designing is enhanced to make wide and various utilizations possible.

For the connecting structure, the portions of both members that face the sealing member themselves are not necessarily provided connecting means to connect them with each other directly. The opening portions of both members themselves may be in the shapes and sizes different from each other. The hole portion of the sealing member may be in the shape and size different from any one of the opening portions of both members. In other words, it is possible to effectuate the bonding having a high sealing capability even without any tight connection, such as fitting of both members and the sealing member. Therefore, the bonding faces of both members and the shape and size of the sealing member can be selected freely to a considerable extent, while the dimensional precision needed for bonding with the secured sealing capability, that is, the precision of a product formation and assembling precision, can be eased considerably as compared with the conventional art. This makes manufacture easier, and reduces the generation of defective products.

It is preferable to provide at least on one face of the flat portion of the sealing member with a connecting portion for use of positioning on the inner side of the ribs surrounding said opening portion, and then, of the bonding faces of both of members on the side of the portion that faces the connecting portion for use of positioning, a portion being connected is provided to engage with the connecting portion for use of positioning. Here, the connecting portion for use of positioning is either one of a boss and a recessed portion, and the portion being connected is the other one of them.

Still another feature of the present invention is such that for the liquid discharge recording head, which comprises a recording unit for recording by discharging liquid droplets from discharge ports, and a recording liquid storing unit connected with the recording unit for supplying recording liquid, the recording unit is provided with a supply hole serving as an opening portion for supplying recording liquid, and the recording liquid storing unit is provided with a recording liquid storing chamber having one side portion serving as an opening portion, and then, the bonding face, which is provided with the supply hole of the recording liquid storing unit formed therefor by penetrating the face, and the bonding face, which is positioned on the opening portion of the recording liquid storing unit, are bonded through a sealing member having any one of the aforesaid structures, and the sealing member is held in a state where the ribs are nipped and compressed between the bonding face of the recording unit and the bonding face of the recording liquid storing unit.

With the structure thus arranged, the recording unit and the recording liquid storing unit can be bonded extremely simply by nipping the sealing member between both members, and along with it, the liquid discharge recording head can be manufactured easily at lower costs. Further, the recording unit and the recording liquid storing unit are bonded by use of snapping fits with the sealing member being nipped between them, but not adhesively bonded. Thus, while the sealing capability is kept, dismantling of the product after use can be performed with ease, and the structure makes recycling easier, and preferably adoptable in terms of dealing with the environmental problems, too. Also, the supply hole of the recording unit and the opening portion of the recording liquid storing unit, that is, the sectional area of flow path through which liquid flows, may be formed in various shapes, such as a circle, a polygon, so as to be configure it to follow the entire shape of the liquid discharge recording head. For the higher speed recording of the liquid discharge recording head, the flow path section in the form of rectangle can be easily expanded in such a manner that while the sorter side is left intact, only the longer side is made larger, for example.

The opening portion of the recording liquid storing unit is such that one side portion of the recording liquid storing chamber is totally open to the outside, and it is preferable to make the shape of the opening portion equal to the sectional shape of the recording liquid storing chamber. It is preferable to form the frame member, which is provided with the recording liquid storing chamber and serves as the principal part of the recording liquid storing unit, by a single member.

With the structure thus arranged, it is unnecessary to execute steps to bond plural components for the formation of the frame member. As a result, no steps are needed to inspect the bonding portions to make it possible to reduce the manufacturing costs of the product, and also, to curtail the number of half products (the half products on the way of manufacture), as well as to curtail the costs that may incur from the defective products. Here, the overall cost down is possible eventually. Also, a single member forms the structure, not by bonding plural members. The strength against external shocks is improved to enhance the reliability. Also, the flow path section on the connecting portion with the recording unit can be expanded to the maximum sectional area of the recording liquid storing chamber, thus making it possible to establish the same capability as the maximum capability of recording liquid supply provided for the recording liquid storing unit. In other words, it becomes possible to utilize the recording liquid storing chamber efficiently to the maximum. Thus, the recording liquid storing unit can be made smaller to the minimum dimensions required for the supply capability. Also, the area of the supply hole of the recording unit is set within a range of the recording liquid supply capability of the recording liquid storing unit, hence making it possible to attempt the optimization of the supply capability.

The recording unit is provided with the supply tube, for which the supply hole is formed to penetrate the bonding face of the recording unit, and the outer shape of the supply tube is smaller than the opening portion of the recording liquid storing unit and the hole portion of the sealing member. The supply tube may be inserted, not tightly but with a gap, into the opening portion of the recording liquid storing unit and the hole portion of the sealing member.

It is preferable to arrange a filter for the supply hole in order to remove mixed particles in recording liquid.

It is also preferable to provide at least on one face of the flat portion of the sealing member a connecting portion for use of positioning on the inner side of the ribs surrounding each of the opening portions, and also, to provide for the bonding faces of the recording unit and the recording liquid storing unit a portion being connected to engage with the connecting portion for use of positioning on the side of the portion facing the connecting portion for use of positioning, and then, to arrange the connecting portion for use of positioning by either one of a boss and a recessed portion, and the portion being connected by the other one of them. In this way, it becomes possible to prevent the positional deviation, twisting, or the like when the sealing member is nipped between the recording unit and the recording liquid storing unit, thus preventing liquid leakage or defect connection that may take place along such unfavorable event.

The recording unit is provided with a recording element base plate having plural recording elements arranged therefor, and a flow path formation member for supply recording liquid to the recording element base plate, and the bonding face with the recording liquid storing unit and the supply hole may be arranged for the flow path formation member.

In this respect, the sealing member and the connecting structure of the present invention are not only applicable to the connecting portion between the recording liquid storing unit and the recording unit, but also, applicable to the connecting portion where a sealing member inclusively exists between two member each having opening portion, in general, so as to seal such connecting portion from the outside, while enabling the opening portion of one member to be communicated with the opening portion of the other member.

DETAILED DESCRIPTION OF THE PREFERRED EMBODIMENTS

Figure 1:
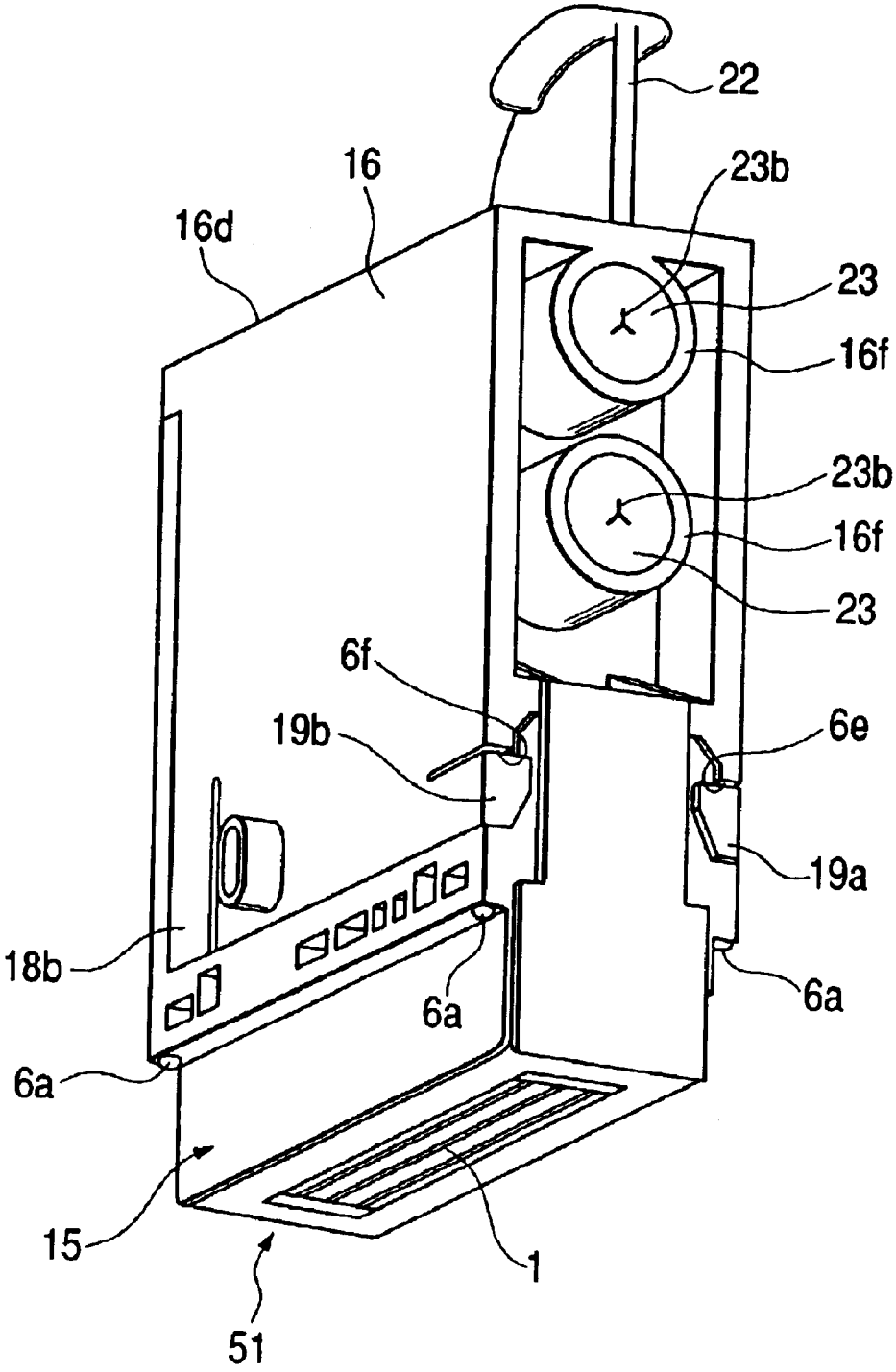
FIG. 1 is a perspective view that shows the outer appearance of a liquid discharge recording head in accordance with the present invention.
Figure 2:
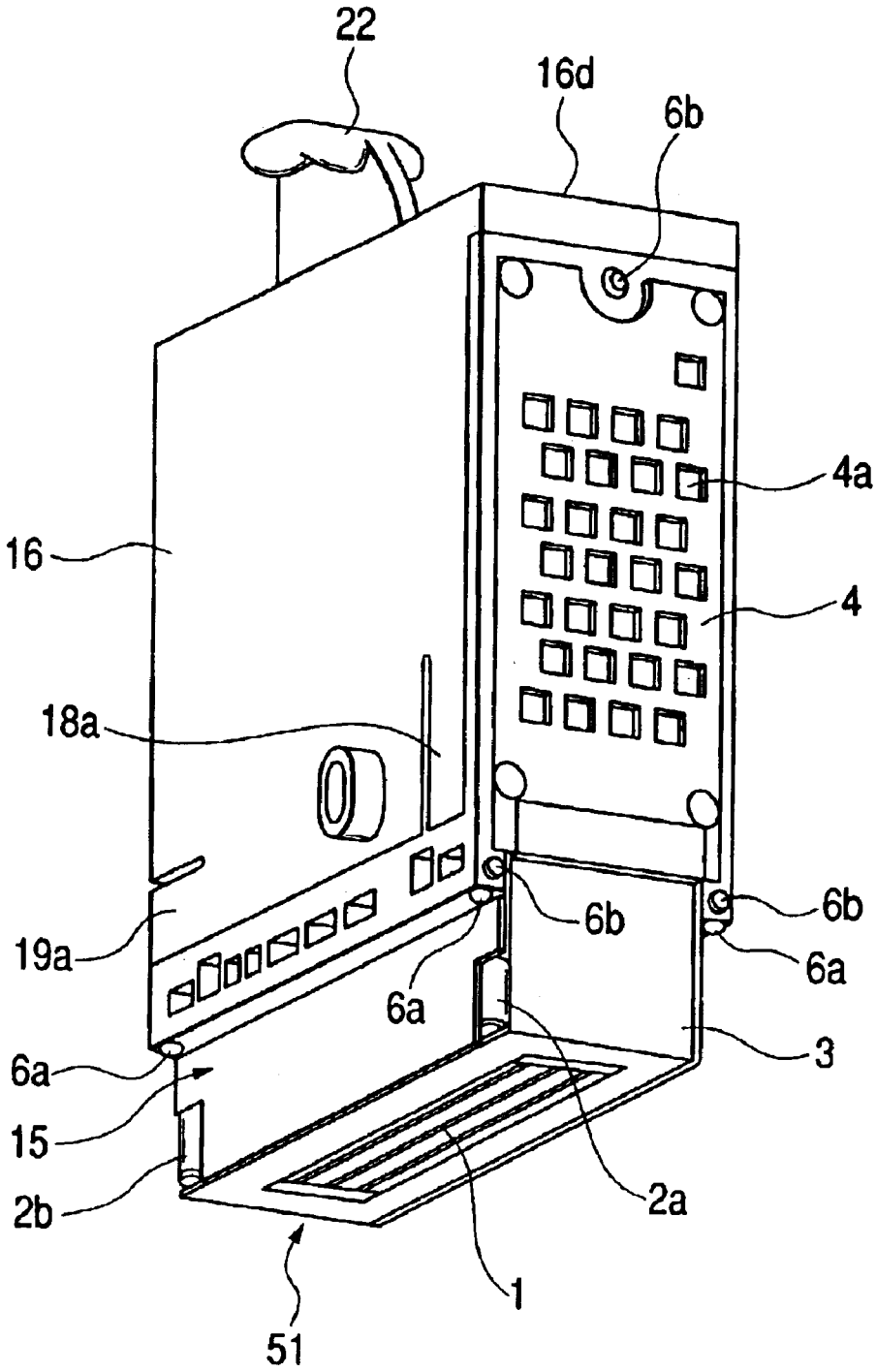
FIG. 2 is a perspective view that shows the liquid discharge recording head of the present invention represented in FIG. 1, observed in the opposite direction.
Figure 3:
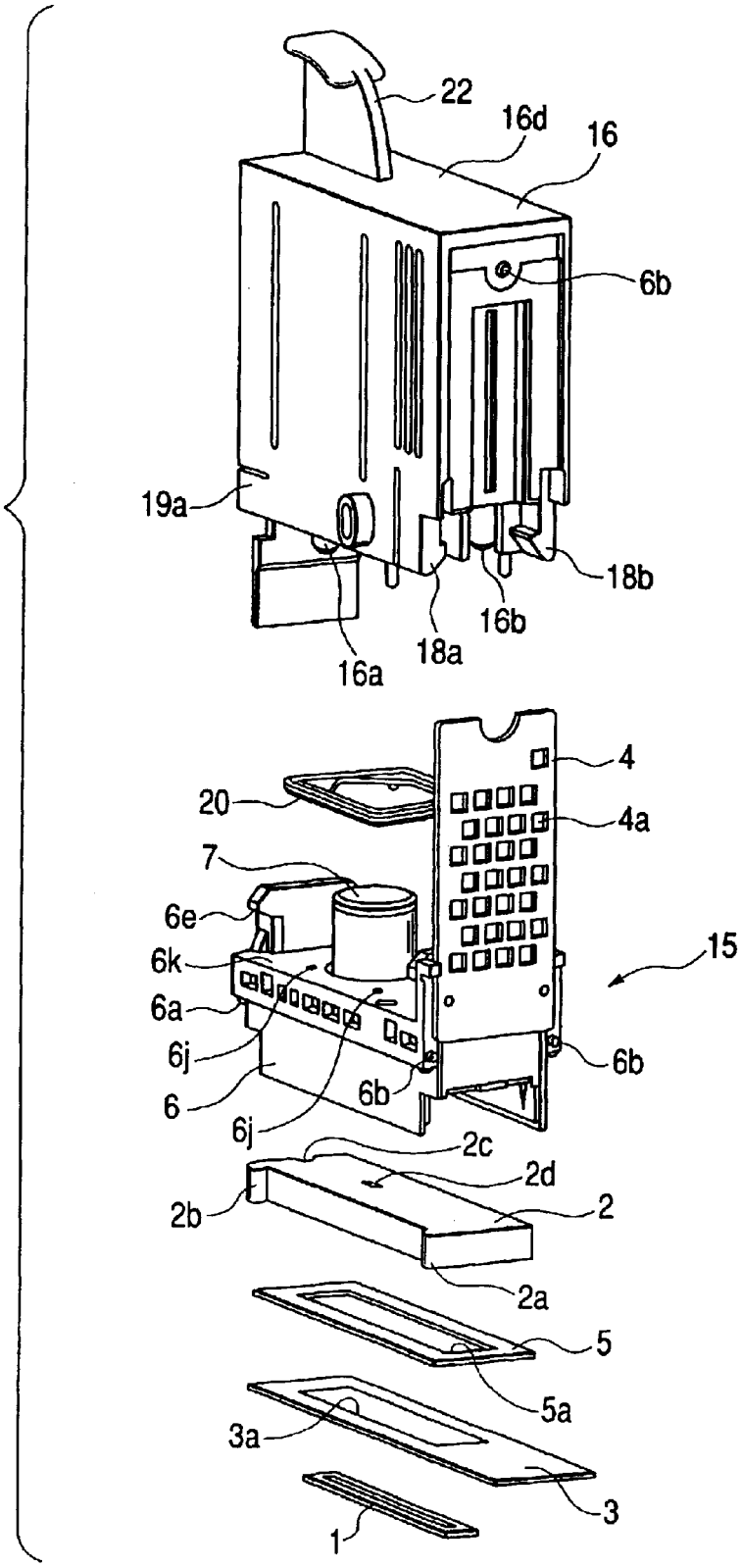
FIG. 3 is an exploded perspective view that shows the liquid discharge recording head in accordance with the present invention.
Figure 4A:
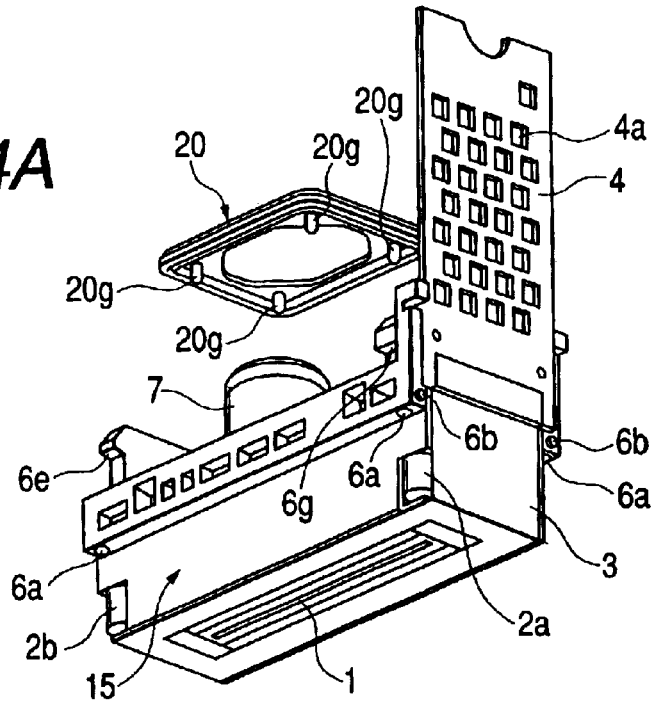
FIG. 4A is an upper perspective view that shows the outer appearance of a part of the liquid discharge recording head in accordance with the present invention.
Figure 4B:
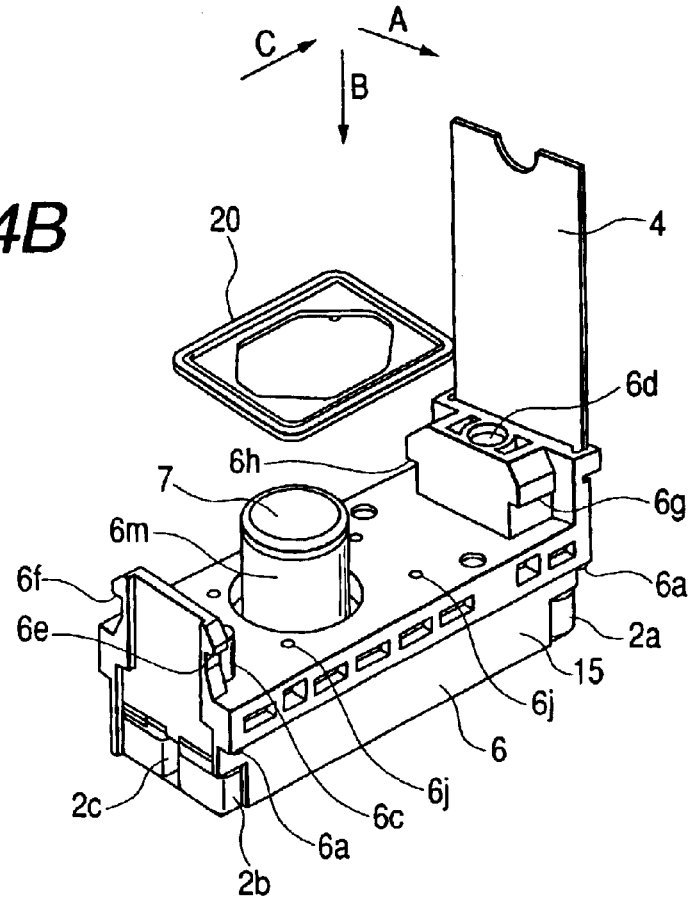
FIG. 4B is a lower perspective view that shows such part of the liquid discharge recording head represented in FIG. 4A.
Figure 5:
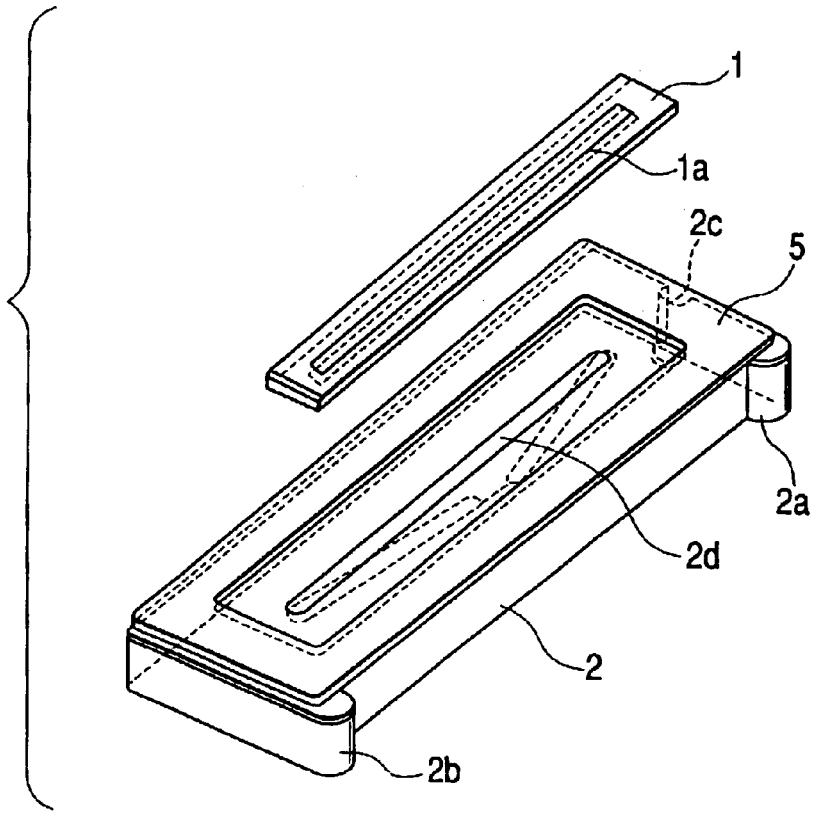
FIG. 5 is a partial perspective view that shows the extracted portion of the liquid discharge recording head in accordance with the present invention.
Figure 6:
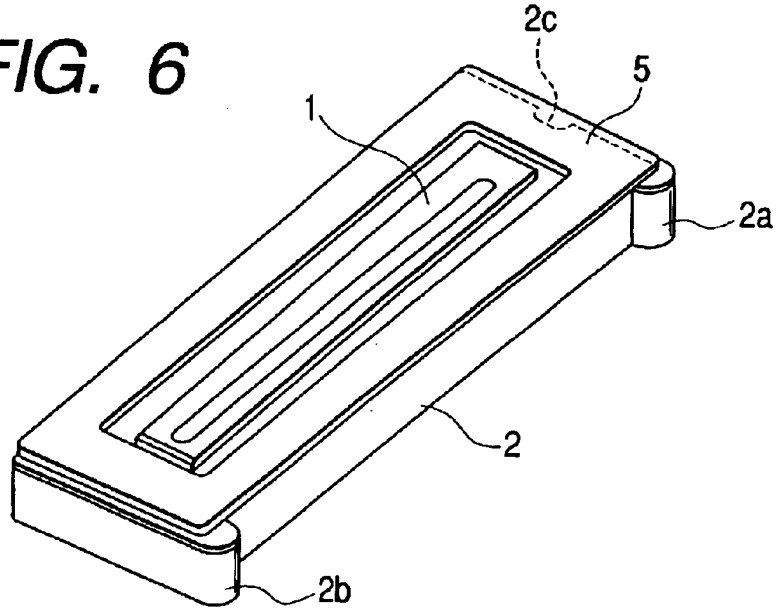
FIG. 6 is a perspective view that shows the outer appearance of such extracted portion of the liquid discharge recording head in accordance with the present invention.
Figure 7:
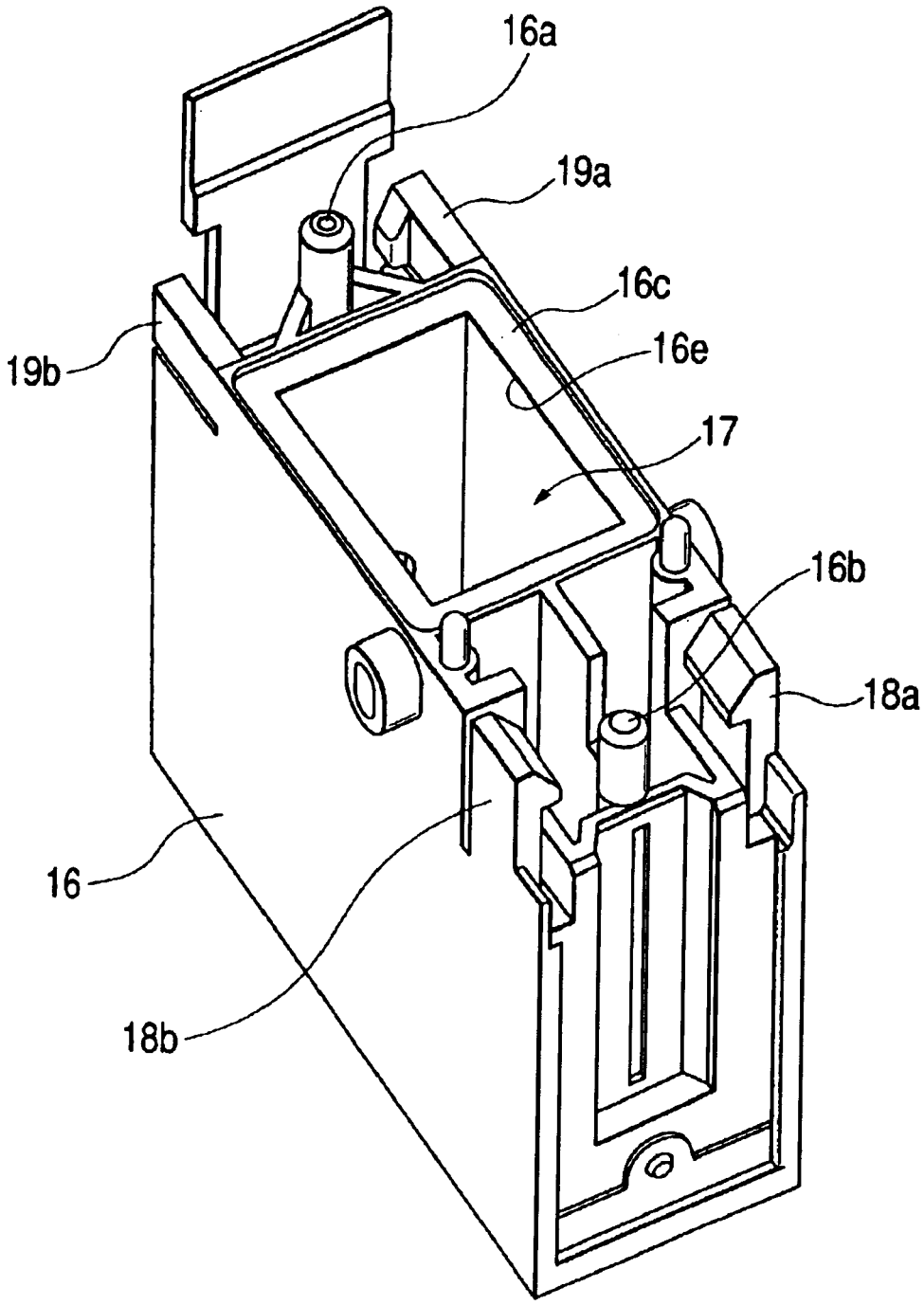
FIG. 7 is a lower perspective view that shows the outer appearance of the recording liquid storing unit of the liquid discharge recording head in accordance with the present invention.
Figure 8:
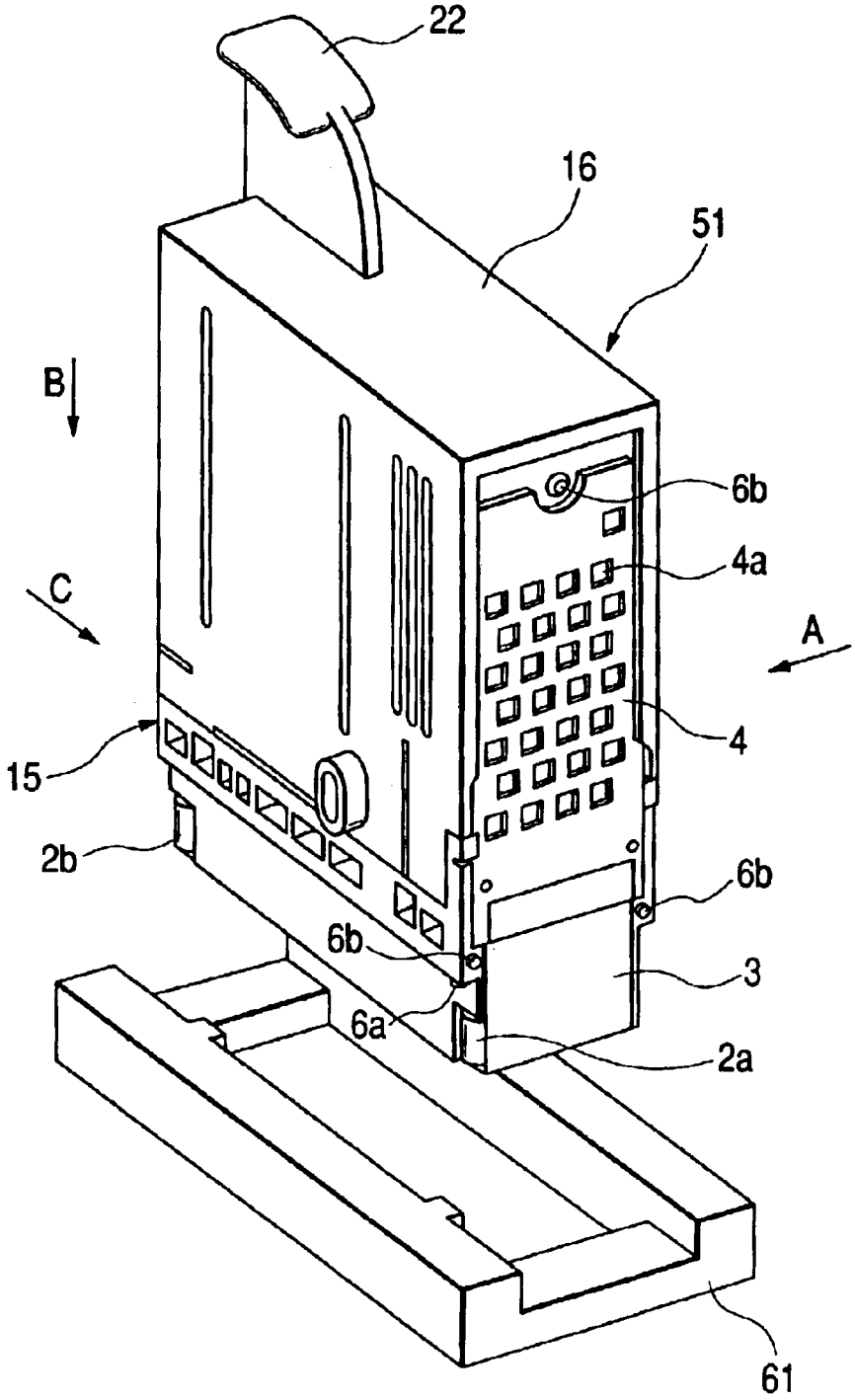
FIG. 8 is a perspective view that shows the outer appearance of the liquid discharge recording head of the present invention before the carriage is mounted.
Figure 9:
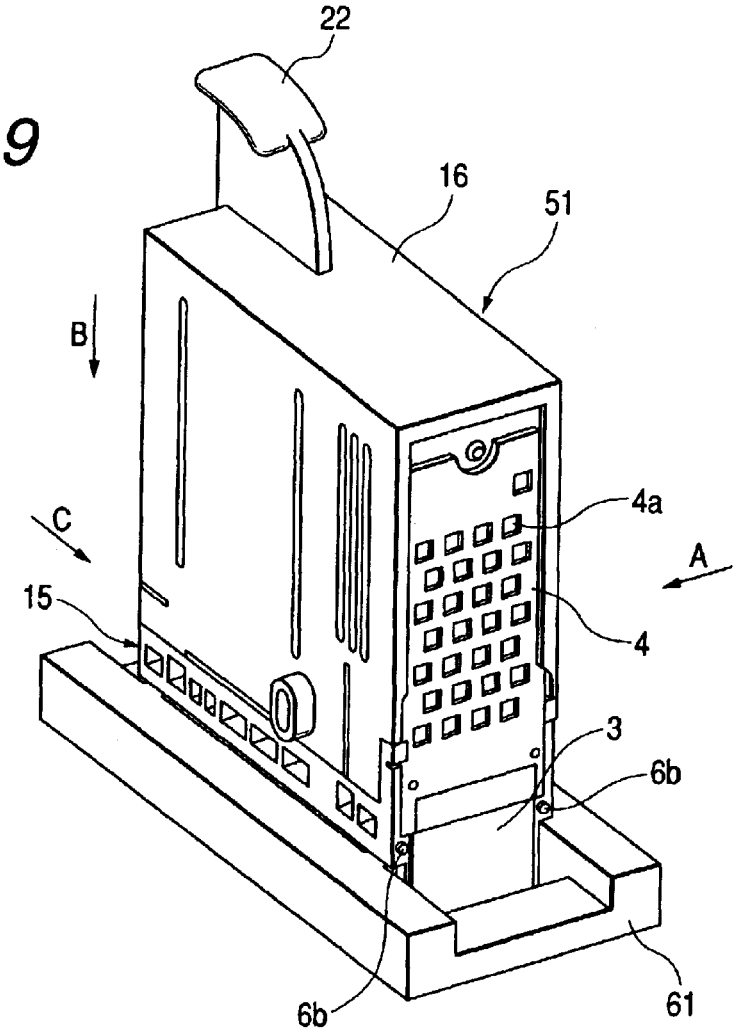
FIG. 9 is a perspective view that shows the outer appearance of the liquid discharge recording head of the present invention after the carriage is mounted.
Figure 10:
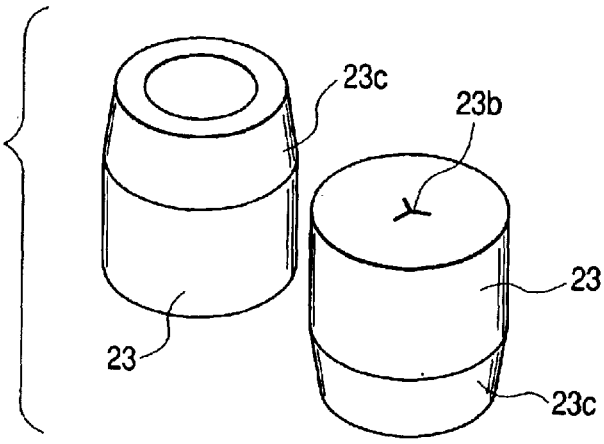
FIG. 10 is a perspective view that shows the joint rubber of the liquid discharge recording head of the present invention.
Figure 11:
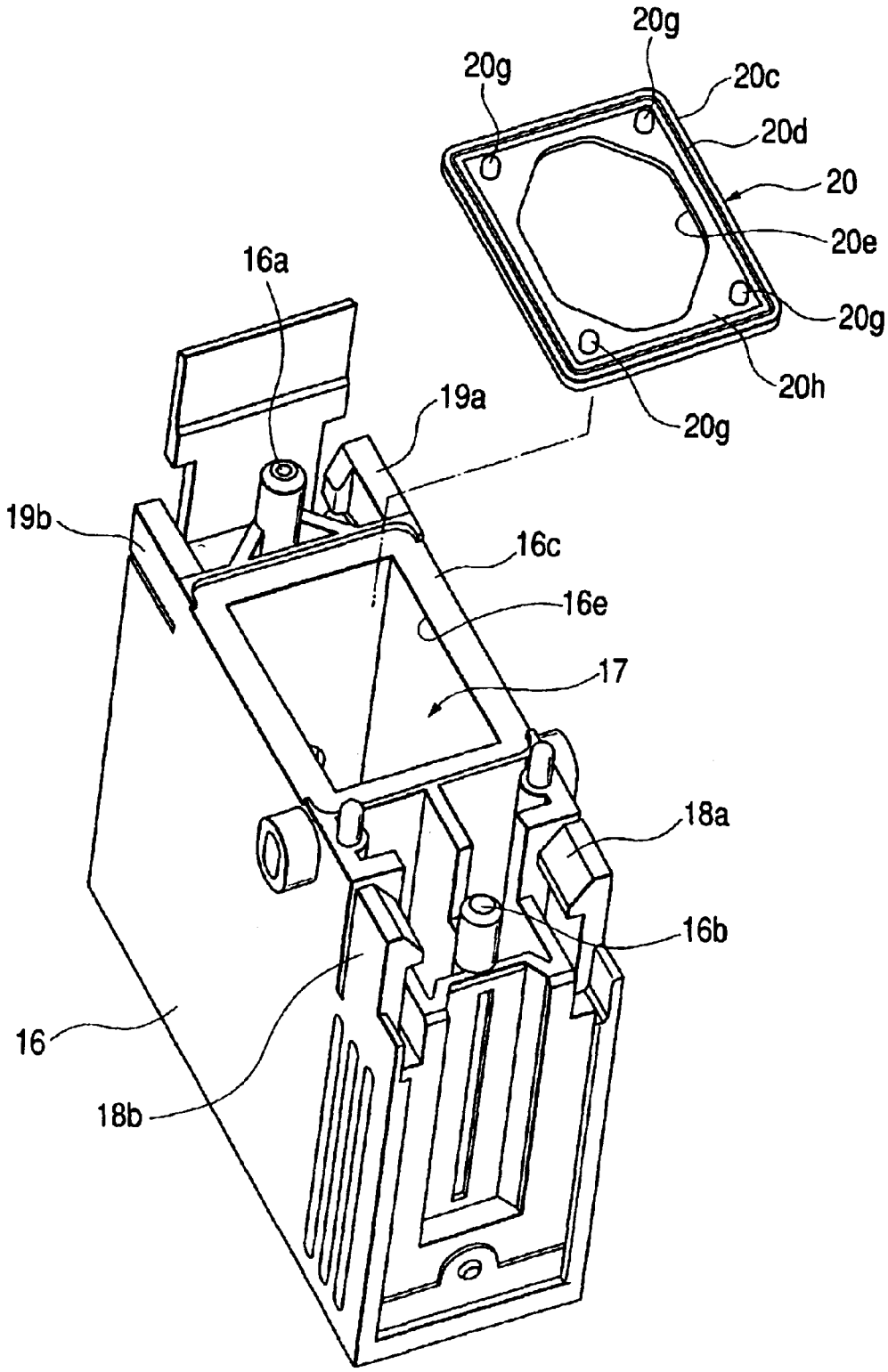
FIG. 11 is a perspective view that shows the relations between the sealing member and the recording liquid storing unit of the liquid discharge recording head in accordance with the present invention.
Figure 12:
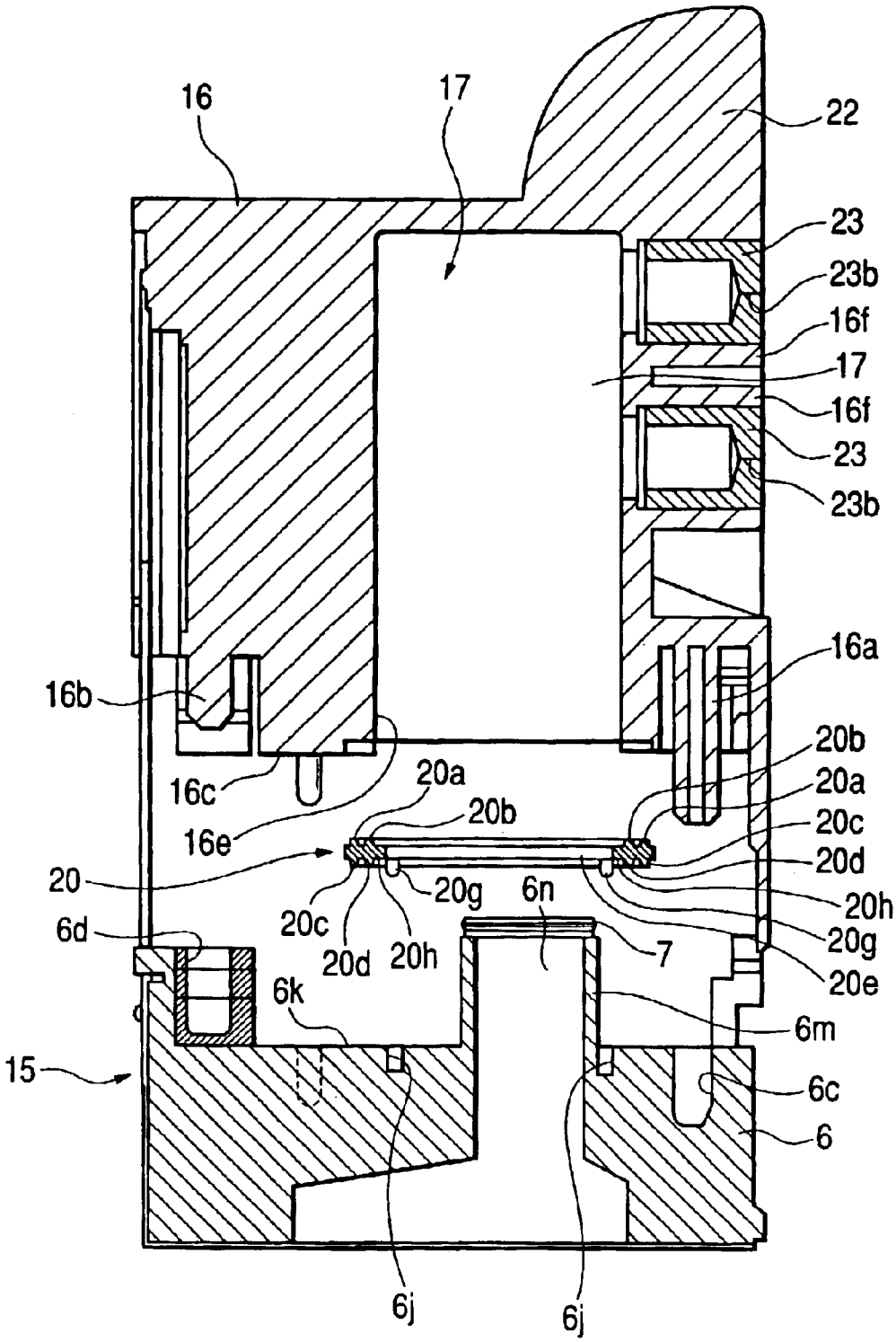
FIG. 12 is an exploded sectional view that shows the liquid discharge recording head in accordance with the present invention.
Figure 13:
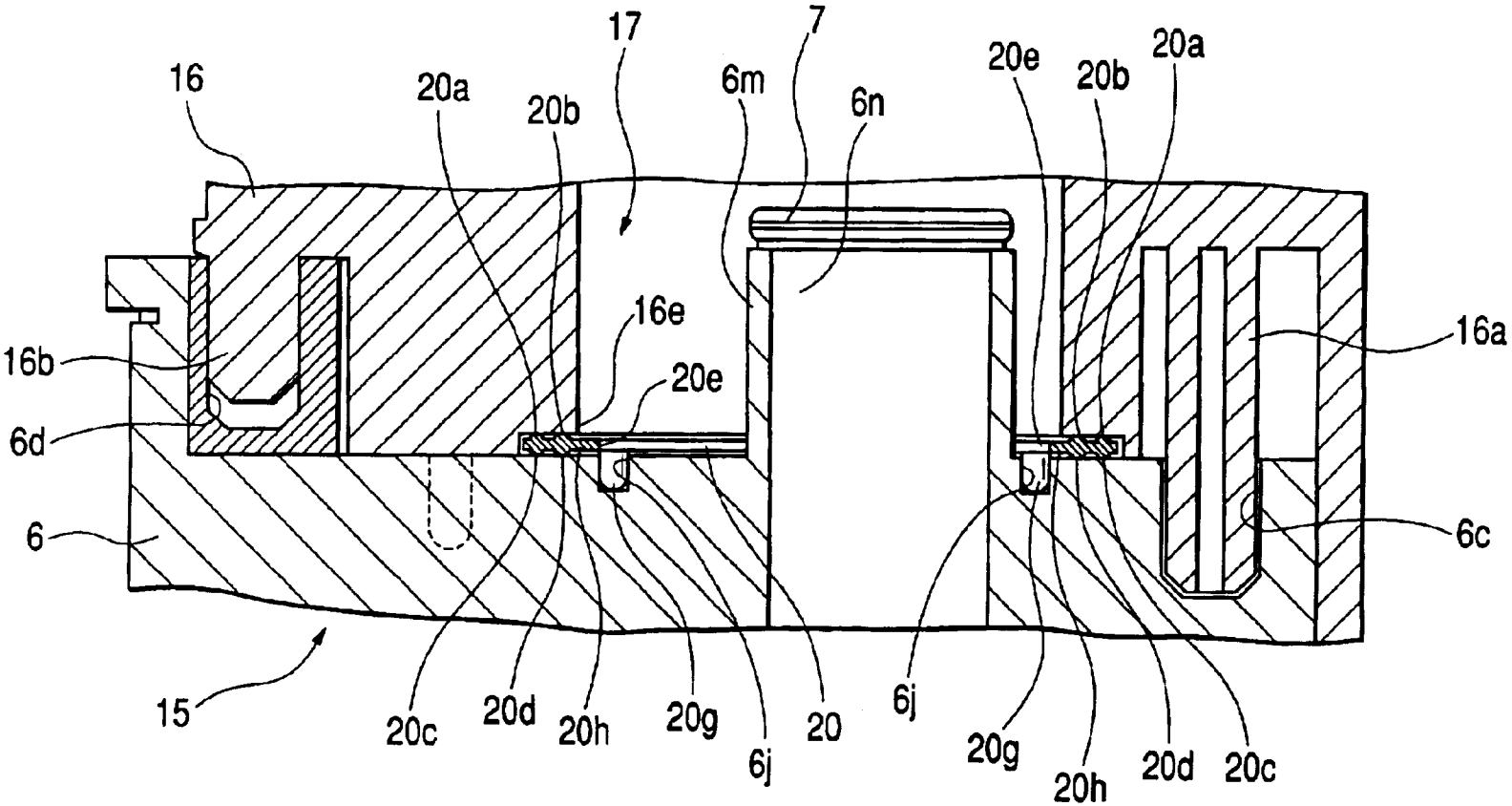
FIG. 13 is a cross-sectional view that shows the enlargement of the principal part of the liquid discharge recording head in accordance with the present invention.

Hereinafter, with reference to FIG. 1 to FIG. 13, the embodiments will be described in accordance with the present invention. In this respect, FIG. 1 and FIG. 2 are perspective vies that illustrate the outer appearance of the liquid discharge recording head 51 of the invention. FIG. 3 is an exploded view thereof. FIG. 4A and FIG. 4B are exploded perspective views that illustrate the recording unit 15 thereof. FIG. 4A is the upper view of the recording unit 15. FIG. 4B is the lower view of the recording unit 15. FIG. 5 and FIG. 6 are partial perspective view of the outer appearance for the illustration of the method for bonding the recording element base plate 1 to the first plate 2. FIG. 5 shows the exploded condition thereof. FIG. 6 shows the bonded condition thereof. FIG. 7 is a lower perspective view that shows the outer appearance of the recording liquid storing unit of the liquid discharge recording head 51. FIG. 8 and FIG. 9 are perspective views that schematically illustrate the method for mounting the liquid discharge recording head 51 on the carriage 61. FIG. 8 shows the state before it is mounted on the carriage 61. FIG. 9 shows the state after it is mounted on the carriage 61. FIG. 10 is a perspective view that shows the joint rubber 23. FIG. 11 is an exploded view that shows the relations between the recording liquid storing unit and the sealing member 20. FIG. 12 and FIG. 13 are exploded sectional views of the liquid discharge recording head 51.

The liquid discharge recording head 51 of the present embodiment is the so-called cartridge type, which is structured by the recording unit (hereinafter referred to as a "head chip") 15, and the recording liquid storing unit provided with the recording liquid storing chamber (ink retaining chamber) 17 (see FIG. 7) that retains recording liquid to be supplied to the head chip 15, while having, as the principal part thereof, the frame member 16, which holds the head chip 15 and functions to be a housing, and the sealing member 20 arranged for the bonding portion between the head chip 15 and the frame member 16, and detachably mounted on the carriage 61 (see FIG. 8) of the liquid discharge recording apparatus main body.

The head chip 15 is provided with the liquid droplet discharge mechanism that discharges liquid droplets from the discharge port array formed with the discharge ports (orifices) in line to discharge liquid droplets in accordance with recording signals, and the sheet wiring member, such as flexible cable, TAB (Tape Automated Bonding), provided with electric wiring to receive and transmit the printing signals transmitted between the liquid droplet discharge mechanism and the liquid discharge recording apparatus main body. More specifically, as shown in FIG. 3, for the head chip 15, the second plate 5 and the sheet wiring base plate 3 are laminated on one face of the first plate 2, and further, the recording element base plate 1 is laminated in the opening portion 5*a* of the second plate 5 and the opening portion 3*a* of the sheet wiring base plate 3. The other face of the first plate 2 is fixed to the flow path formation member 6, and on the flow path formation member 6, the contact terminal wiring base plate 4 (see FIG. 8 and FIG. 9), and the porous member 7 are installed.

The recording element base plate 1 is formed by Si, and on the one face thereof, plural recording elements for discharging recording liquid, and the wiring, such as Al, for supplying electric power to each of the recording elements is formed by use of the film formation technologies and techniques. Further, plural recording liquid flow paths corresponding to each of the recording elements, and plural discharge ports, which are communicated with the recording liquid flow paths, and penetrate in the thickness direction, are formed by use of the photolithographic techniques, while the recording liquid supply port 1*a* (see FIG. 5) is formed for supplying recording liquid to the plural recording liquid flow paths.

As shown in FIG. 5 and FIG. 6, circular extrusions 2*a* and 2*b* are provided on both end portions of the first plate 2 in the longitudinal direction, and a circular groove 2*c* is provided on the one side face in the widthwise direction. Further, the recording liquid supply port 2*d*, through which recording liquid is supplied, is formed for the recording element base plate 1 to penetrate in the direction of the plate thickness thereof. To the first plate 2, the recording element base plate 1 and the second plate 5 are bonded. For the second plate 5, the opening portion 5*a* is formed in order to avoid interference when the recording element base plate 1 is assembled.

The bonding of the recording element base plate 1 to the first plate 2 is made by effectuating the alignment of the relative positions and inclinations of the arrangement surface of the recording elements of the recording element base plate with the plane (a first reference plane) that includes the vertices (protruded portions) of the two circular extrusions 2*a* and 2*b*, and the circular groove 2*c*, which serve as the references. In this way, the relative positions of the recording element base plate 1 and the first plate 2 can be set by the semiconductor assembling technologies and techniques in high precision. Then, assembling is possible with a small amount of inclination of the arrangement surface of recording elements of the recording element base plate 1. Further, by setting the distance between the vertices of the two circular extrusions 2*a* and 2*b* of the first plate 2 larger than the arrangement length of recording elements of the recording element base plate 1, it becomes easier to adjust the inclination of the recording element base plate 1 to the first reference plane when the alignment process is carried out. Thus, the alignment precision is enhanced to stabilize production.

Since the first plate 2 is a flat member, plane precision between the assembled surface of the recording element base plate 1 and the opposite surface thereof, and the parallelism between the assembled surface of the recording element base plate 1 and the opposite surface can be obtained in high precision when manufactured. As a result, the bonding device for the recording element base plate 1, it becomes possible to structure the base stand for mounting the first plate 2 simply, and to mount the first plate 2 on the base stand in high precision. In this way, the alignment precision of the recording element base plate 1 is enhanced with respect to the first plate 2. Therefore, the precision of the relative inclinations between the first reference plane of the first plate 2 and the recording element base plate 1 becomes more favorable, hence making it possible to attempt the enhancement of productivity of the liquid discharge recording head 51. Also, the first reference plane of the side face of the first plate 2 is in parallel to the recording element base plate 1 in the longitudinal direction thereof. Consequently, unlike the case where both of them are arranged to be orthogonal, the observation area of work is made smaller on the bonding device for the recording element base plate 1, hence making the alignment process easier for the first plate 2 and the recording element base plate 1, and also, making the operation time shorter. Moreover, the mounting space of the work is made smaller, leading to the lower cost-manufacture of the bonding device.

As shown in FIG. 1 to FIGS. 4A and 4B, the first plate 2 is fixed to the flow path formation member 6 by bonding means, such as bonding agent, screws. By the bonding of both of them, the recording flow path of the first plate 2 and the recording flow path of the flow path formation member 6 are connected. Inside the flow path formation member 6, the flow path of recording liquid is formed and one end portion of the flow path is connected with the recording liquid supply port 2*d* of the first plate 2, and as shown in FIG. 12 and FIG. 13, the other end portion becomes the supply hole 6*n* that penetrates a supply tube 6*m*. The supply hole 6*n* is the opening portion of the head chip 15, to which a porous member 7 is bonded. The porous member 7 is positioned at the end portion of the flow path of recording liquid, thus preventing dust particles mixed in recording liquid from entering from the upstream side. Also, for the flow path formation member 6, there are provided the extrusions, which become means for positioning the liquid discharge recording head 51, that is, more specifically, the spherical boss 6*a*, which is means for positioning the liquid discharge recording head 51 in the direction indicated by an arrow A, and the extruded portion 6*b*, which is means for positioning in the direction indicated by an arrow C. Also, for the flow path formation member 6, there are arranged holes 6*c* and 6*d* to which are fitted the bosses 16*a* and 16*b* of the frame member 16 of the recording liquid storing unit to be described later, and the first receiving portions 6*g* and 6*h* and the second receiving portions 6*e* and 6*f*, which engage respectively with the first snapping fits 18*a* and 18*b* and the second snapping fits 19*a* and 19*b* of the frame member 16, which will be described later.

For the second plate 5, which is fixed to the first plate 2, the sheet electric wiring base plate 3 is held and bonded thereto. Then, the sheet electric wiring base plate 3 is electrically connected with the recording element base plate 1. Further, the contact terminal wiring base plate 4 is positioned and fixed to the one side face of the flow path formation member 6, and connected with the sheet electric wiring base plate 3 by means of ACF, lead bonding, wire bonding, connector, or the like. For the contact terminal wiring base plate 4, an external signal input terminal 4*a* is provided in order to receive electric signals from the liquid discharge recording apparatus main body. These electric wiring portions (a series of wiring portions formed by connecting the sheet electric wiring base plate 3 and the contact terminal wiring base plate 4) function to apply electric signals to the recording element base plate 1 for discharging recording liquid, which are provided with electric wires corresponding to the recording element base plate 1. For the end portion of the electric wiring, the external signal input terminal 4*a* is arranged. Here, the electric wiring portions are not necessarily formed to be the structure in which the sheet electric wiring base plate 3 and the contact terminal wiring base plate 4 are arranged as separate members. Such structure may be the one in which the sheet electric wiring base plate 3 and the contact terminal wiring base plate 4 are formed by one and the same member.

Next, the structure of the recording liquid storing unit will be described.

As shown in FIG. 7 and FIGS. 11 to 13, the frame member 16, which is the principal part of the recording liquid storing unit, is bonded to the flow path formation member 6 of the head chip 15 to function as a housing of the liquid discharge recording head 51. Inside the frame member 16, the recording liquid storing chamber (ink retaining chamber) 17 is provided to contain a desired amount of recording liquid and retain recording liquid thus contained provisionally or until it is used completely. If the inner circumference of the recording liquid storing chamber 17 is projected to the surface 16*c* bonded to the flow path formation member 6, it is ascertained that this inner circumference is in agreement with that of the bonded surface 16*c*. Here, the bonded surface 16*c* of the frame member 16 is the end face of the wall that divides the recording liquid storing chamber 17, and it does not expand wider toward the inner side of the recording liquid storing chamber 17. In other words, in the frame member 16, one side portion (on the bonded surface 16*c* side) of the recording liquid storing chamber 17 is totally open to the outside, and becomes the opening portion 16*e*. The shape of the opening portion 16*e* is equal to the sectional shape of the recording liquid storing chamber 17, and the sectional area of the recording liquid storing chamber 17 is not made smaller in the opening portion 16*e*, that is the portion bonded to the flow path formation member 6.

For the frame member 16, there are provided the bosses 16*a* and 16*b* corresponding to the holes 6*c* and 6*d* (see FIGS. 4A and 4B) of the flow path formation member 6 described earlier, and the first snapping fits 18*a* and 18*b* and second snapping fits 19*a* and 19*b*, which correspond to the first receiving portions 6*g* and 6*h* of the flow path formation member 6 and the second receiving portions 6*e* and 6*f* (see FIGS. 4A and 4B). Then, as shown in FIG. 1 to FIG. 3, and FIG. 13, while the bosses 16*a* and 16*b* are inserted into the holes 6*c* and 6*d* for positioning, the first snapping fits 18*a* and 18*b*, and the second snapping fits 19*a* and 19*b* are hooked by the first receiving portions 6*g* and 6*h*, and the second receiving portions 6*e* and 6*f*, thus connecting and fixing the frame member 16 and the flow path formation member 6 completely.

As shown in FIG. 1 to FIG. 3, for the ceiling face 16*d* of the frame member 16, the handle 22 is provided to serve as a hand hold when the liquid discharge recording head 51 is attached to and detached from the carriage 61 of the liquid discharge recording apparatus main body.

Also, as shown in FIG. 1, FIG. 3, and FIG. 12, for one side face (the face on the side opposite to the contact terminal wiring base plate 4) of the frame member 16, the cylindrical portions 16*f*, which are arranged to be in line up and down, and communicated with the recording liquid storing chamber 17, are provided, and joint rubbers 23 are inserted into the cylindrical portions 16*f*, respectively. More precisely, as shown in FIG. 10, the joint rubber 23 is provided with a cracked hole 23*b* in the form of Y-letter slit in the center portion thereof. Also, the joint rubber 23 has the outer diameter larger than the inner diameter of the cylindrical portion 16*f* of the frame member 16, and it is inserted into the cylindrical portion 16*f* while being compressed. Then, the leading end portion thereof in the direction in which it is pressed into the cylindrical portion 16*f* of the frame member 16 is in the tapered form at 23*c* so as to make the insertion thereof in good condition. In the cylindrical portion 16*f* of the frame member 16, the joint rubber 23 is in the state of being compressed. Therefore, the cracked hole 23*b* is kept in the clogged condition. In this way, with the cracked hole 23*b* formed in the Y-letter slit for the joint rubber 23, the needle (not shown) provided for the liquid discharge recording apparatus main body passes the cracked hole 23*b* to be inserted smoothly into the recording liquid storing chamber 17 of the frame member 16 when it is inserted into the joint rubber 23. Also, the cracked hole 23*b* is clogged by receiving compression load from the outer circumferential portion of the joint rubber 23. Therefore, when the needle is not inserted, it is possible to keep the interior of the recording liquid storing chamber 17 in the closed condition. On the other hand, when the needle is inserted, gripping force (compression from the outer circumference) acts on the needle, thus sealing the contact portion with the outer circumference of the needle completely.

The lower joint rubber 23 becomes the supply passage for supplying recording liquid from the external recording liquid storing tank (main tank) of the liquid discharge recording apparatus main (not shown). In other words, the hollow needle, which is communicated with the main tank, is inserted into the recording liquid storing chamber 17 through the cracked hole 23*b*, and then, recording liquid is supplied from the main tank into the recording liquid storing chamber 17 through the needle. On the other hand, the upper joint rubber 23 becomes the suction passage for making the inside of the recording liquid storing chamber 17 negatively pressurized by releasing the air, which is accumulated in the recording liquid storing chamber 17, to the outside of the recording liquid storing chamber 17. In other words, the hollow needle, which is connected with suction driving means, such a pump, is inserted into the recording liquid storing chamber 17 through the cracked hole 23*b*. Then, the air in the recording liquid storing chamber 17 is exhausted to the outside through the needle to control the negative pressure in the recording liquid storing chamber 17. In this way, using the suction passage that includes the upper joint rubber 23 the negative pressure in the recording liquid storing chamber 17 is increased. Then, the force that sucks recording liquid from the supply passage to the recording liquid storing chamber 17, which includes the lower joint rubber 23, acts and makes it possible to control the supply of recording liquid.

For the frame member 16, as described earlier, the sectional area of the recording liquid storing chamber 17 is not made smaller in the bonding portion (the opening portion 16*e*) with the flow path formation member 6. In other words, the recording liquid storing chamber 17 is not narrowed (not squeezed) in the opening portion 16*e*. As a result, when the frame member 16 is molded, it can be drawn from the mold in the direction toward the opening portion 16*e*. There is no need for drawing it in the direction toward the side opposite to the opening portion as in the case of the conventional art. Thus, it becomes possible to form the face (ceiling face) 16*d* of the opening portion 16*e* on the opposite side together with the surrounding wall, that is, to manufacture the frame member 16 to be integrally formed. Here, as described later, the opening portion 16*e* of the recording liquid storing chamber 17 is connected with the supply hole (the opening portion of the recording liquid flow path) 6*n* of the flow path formation member 6 through the sealing member 20 of the present invention. Therefore, it is unnecessary to cover the opening portion 16*e*.

As has been described, the frame member 16, which is the principal part of the recording liquid storing unit provided with the recording liquid storing chamber 17, is not such that it is assembled using plural members, but it is formed integrally. Thus, firstly, the number of parts is reduced to make the structure simpler; secondly, there is no need for such bonding process as ultrasonic welding; and thirdly, no inspection process is required for the half products and defective products are curtailed to reduce the costs of manufacture significantly.

Also, with the structure in which the frame member 16 is formed by the single part, there is no such event that the strength of bonding portion is reduced as in the structure in which it is assembled using plural parts, leading to a higher strength as a whole. Therefore, even if shocks are given by dropping or the like, it is not easily broken. Also, as the bonding portion no longer exists, there is no such drawback that ink leakage or leak occurs on the bonding portion between the frame member cover and the frame member main body for unexpected reasons after the delivery of the liquid discharge recording head 51, which is completed and filled with ink as a finished product, for example. With the simpler part structure as described above, reliability is enhanced significantly.

Also, as described earlier, the recording liquid storing chamber 17 is not narrowed (not squeezed) in the bonding portion (the opening portion 16*e*) with the flow path formation member 6. Consequently, the flow rate of recording liquid flowing out from the recording liquid storing chamber 17 is not reduced at this opening portion 16*e*. When the dimensions of the recording liquid storing chamber 17 is determined in accordance with the amount of recording liquid supply needed for the liquid discharge recording head 51, the bonding surface 16*c* is set so that the opening portion 16*e* exists with the same sectional area as that of the recording liquid storing chamber 17. The flow rate of recording liquid is not reduced at the opening portion 16*e* to make the supply of recording liquid is efficient. As a result, the frame member 16 can be made smaller than the conventional one if the required amount of recording liquid supply is equal. Further, it becomes possible to attempt making the liquid discharge recording head 51 smaller. Conversely, with the liquid discharge recording head 51 of the same size, it is possible to store recording liquid more that the conventional one. However, the flow rate of recording liquid may be affected depending on the configuration of the supply port on the head chip 15 side in some cases.

Figure 14A:
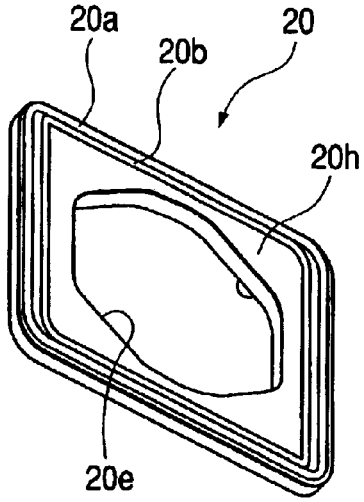
FIG. 14A is an upper perspective view that shows the sealing member in accordance with the present invention.
Figure 14B:
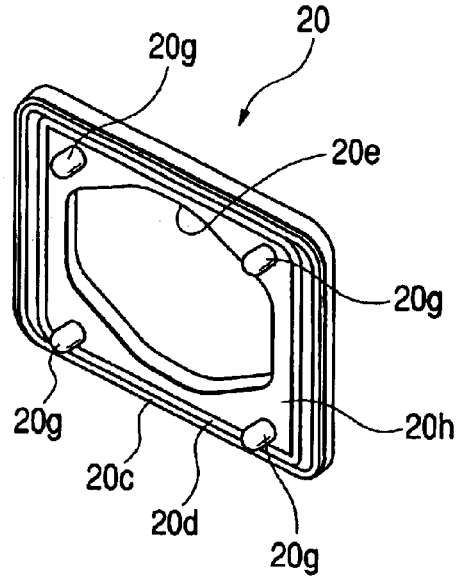
FIG. 14B is the lower perspective view that shows the sealing member represented in FIG. 14A.
Figure 15A:
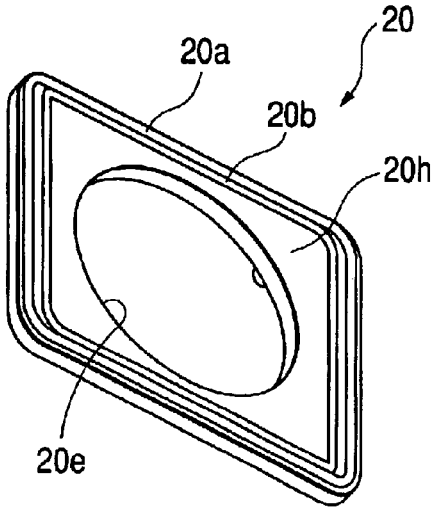
FIG. 15A is an upper perspective view that shows another example of the sealing member in accordance with the present invention.
Figure 15B:
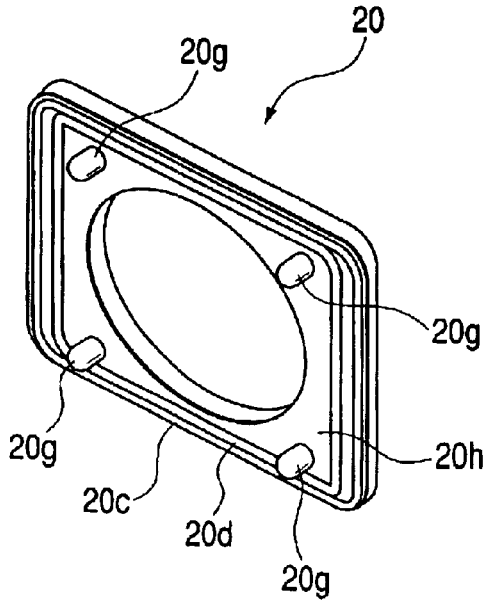
FIG. 15B is the lower perspective view that shows the sealing member represented in FIG. 15A.
Figure 16A:
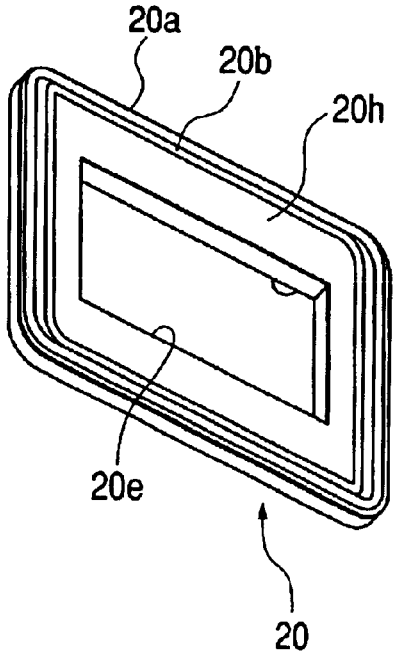
FIG. 16A is an upper perspective view that shows still another example of the sealing member in accordance with the present invention.
Figure 16B:
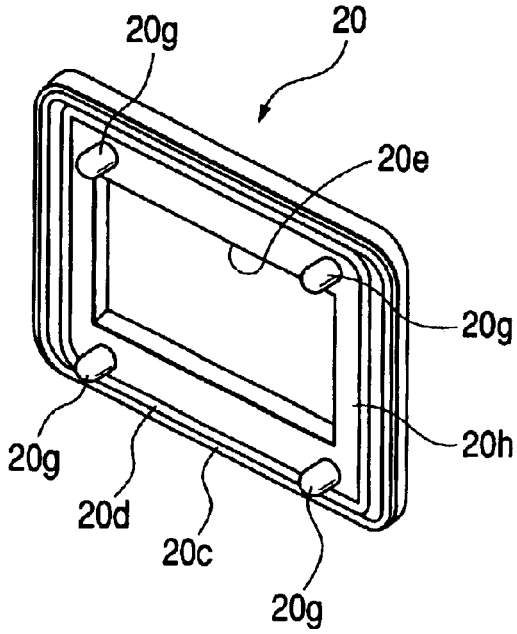
FIG. 16B is the lower perspective view that shows the sealing member represented in FIG. 16A.
Figure 17:
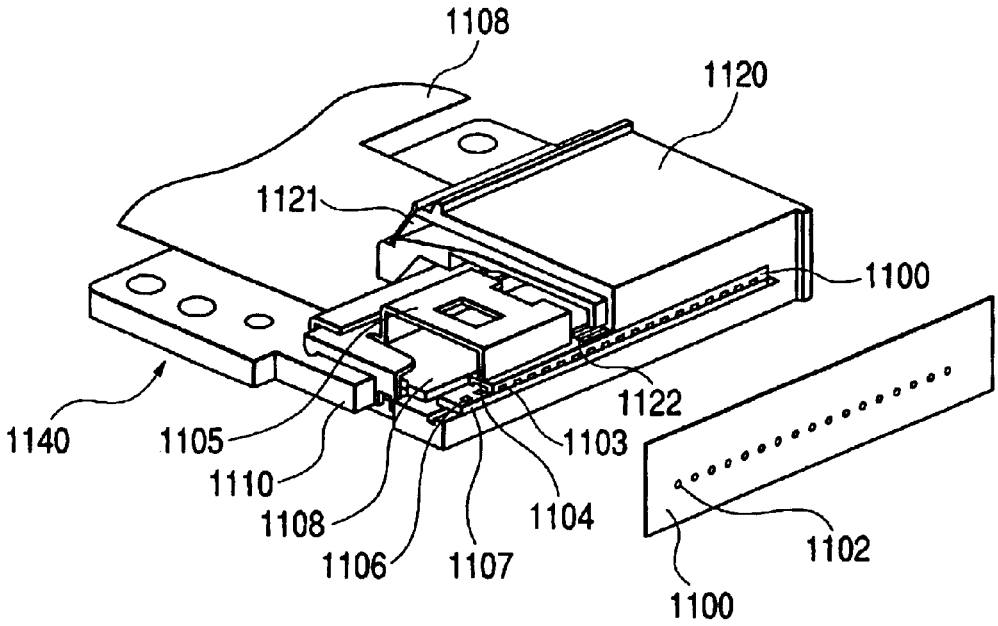
FIG. 17 is a broken perspective view that shows a part of the recording unit of the liquid discharge recording head in accordance with the present invention.
Figure 18:
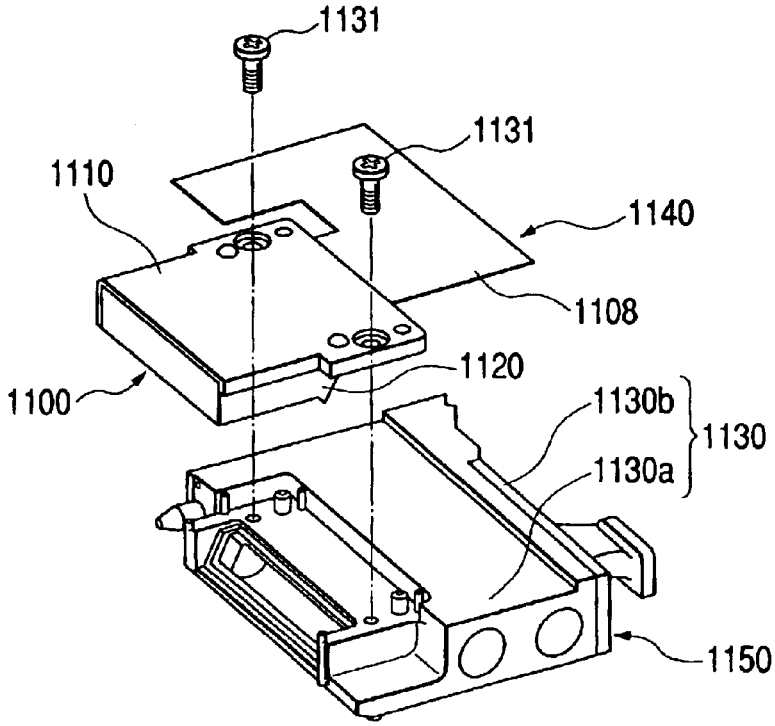
FIG. 18 is an exploded perspective view that shows the conventional liquid discharge recording head.
Figure 19:
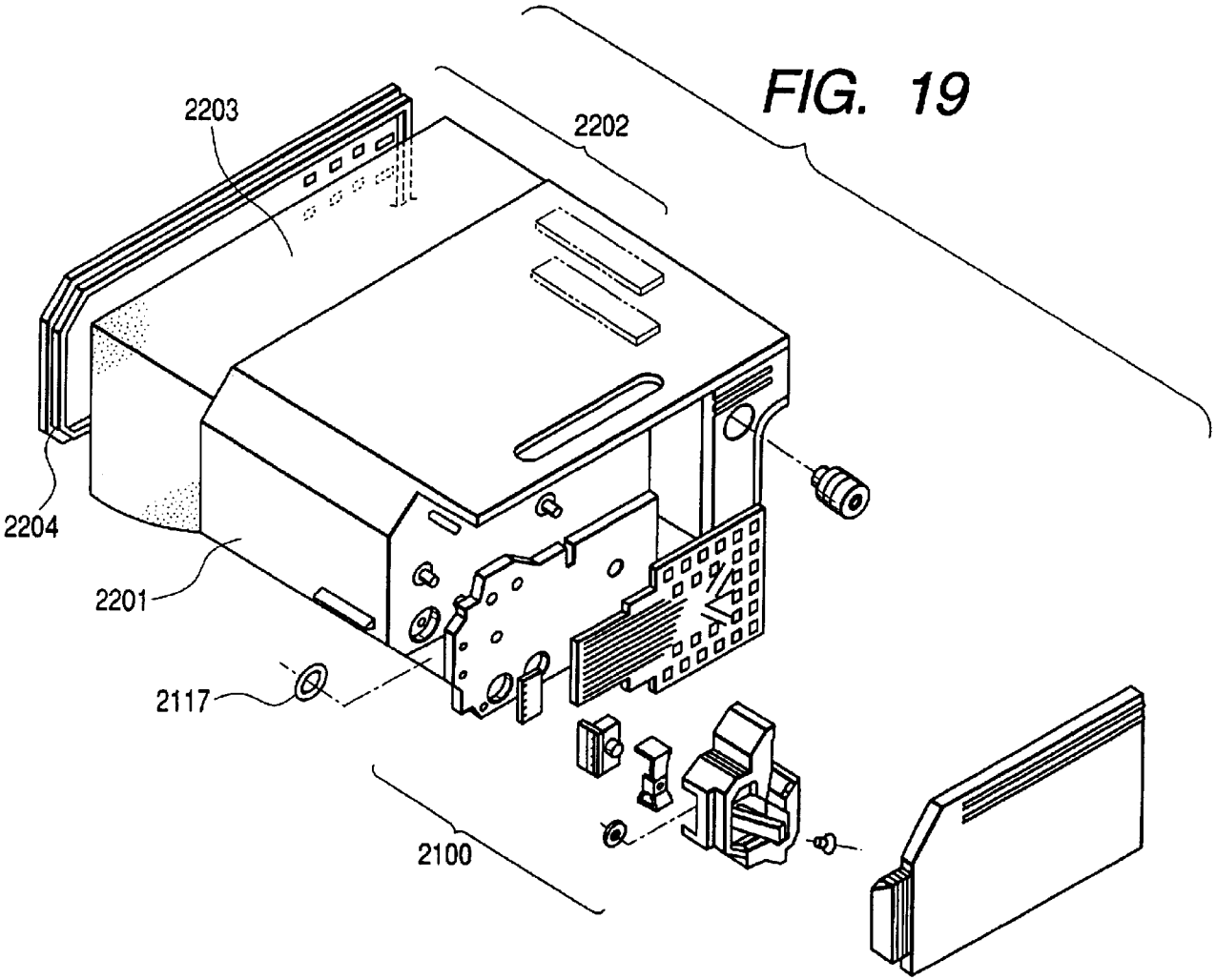
FIG. 19 is an exploded perspective view that shows another example of the conventional liquid discharge recording head.

Next, with reference to FIG. 3, FIGS. 4A and 4B, and FIG. 11 to FIGS. 16A and 16B, the description will be made of the structure of the sealing member 20 arranged for the bonding portion between the head chip 15 and the frame member 16. FIGS. 14A, 15A and 16A are perspective views of the sealing member 20 observed from above, and FIGS. 14B, 15B and 16B are perspective views thereof observed from below.

The sealing member 20 is formed by sheet rubber or by elastomer, and the flat portion 20*h*, which is the main body thereof, is almost rectangular with rounded corners. Inside the sealing member, the hole portion 20*e*, which makes the flow of recording liquid possible, is formed. Then, on both faces of the flat portion 20*h*, double ribs 20*a*, 20*b*, 20*c*, and 20*d* are formed. More specifically, on one face of the flat portion 20*h* of the sealing member 20, there are provided the first face-side rib 20*a* that makes a round substantially along the outer circumference, and the first face-side rib 20*b* configured substantially equal to the first face-side rib 20*a*, which positioned on the inner side thereof, and on the outer side of the hole portion 20*e*. Both of the first face-side ribs 20*a* and 20*b* are set essentially to stand vertically on one face of the flat portion 20*h*. Likewise, on the other face of the flat portion 20*h* of the sealing member 20, there are provided the second face-side rib 20*c* that makes a round substantially along the outer circumference, and the second face-side rib 20*d* configured substantially equal to the second face-side rib 20*c*, which positioned on the inner side thereof, and on the outer side of the hole portion 20*e*. Both of the second face-side ribs 20*c* and 20*d* are set essentially to stand vertically on the other face of the flat portion 20*h*. Then, The first face-side rib 20*a* and the second face-side rib 20*c* are formed on both side with the flat portion 20*h* on the center thereof in the symmetrical positions and configurations. Likewise, the first face-side rib 20*b* and the second face-side rib 20*d* are formed on both side with the flat portion 20*h* on the center thereof in the symmetrical positions and configurations.

The outer shapes of the flat portion 20*h* and the hole portion 20*e* of the sealing member 20 are determined in accordance with the flow rate of recording liquid required for discharging liquid, and a desired outer size of the liquid discharge recording head 51 as a whole. For the present embodiment, the outer shape of the flat portion 20*h* of the sealing member 20 is substantially equal to the outer shape of the frame member 16 corresponding to the entire outer shape of the liquid discharge recording head 51. The hole portion 20*e* is configured in a size good enough to contain the porous member (filter) 7 of the flow path formation member 6 of the head chip 15, which is in a polygon having rounded corners.

The sealing member 20 is nipped between the frame member 16 of the recording liquid storing unit and the flow path formation member 6 of the head chip 15 when these members engage with each other by means of snapping fits. Therefore, the thickness of the flat portion 20*h* is determined with the overall considerations including the material hardness of the sealing member 20, together with the hooking strength of snapping fits, and the aged creeping thereof. Empirically, it is desirable to make the width of the flat portion 20*h* more than three times the thickness thereof. Here, likewise, each of the ribs 20*a*, 20*b*, 20*c*, and 20*d* is given the over all considerations that includes the shape, material, and the like of the members to engage with each other when it is determined.

As shown in FIG. 13, when the frame member 16 of the recording liquid storing unit and the flow path formation member 6 of the recording unit 15 are connected, each rib of the sealing member 20 inclusively exists between them, that is, the first face-side ribs 20*a* and 20*b*, which are extruded on the frame member 16 side, and the second face-side ribs 20*c* and 20*d*, which are extruded on the flow path formation member 6 side, is compressed and smashed by being nipped the lower face portion (bonded face) 16*c* of the frame member 16 and the upper face portion (bonded face) 6*k* of the flow path formation member 6, thus making it possible to seal the passages from the recording liquid storing chamber 17 to the recording liquid flow path completely.

In this manner, ribs 20*a*, 20*b*, 20*c*, and 20*d* are provided for both faces of the flat portion 20*h* of the sealing member 20 to enable the frame member 16, the flow path formation member 6 and the sealing member 20 to be in contact in line, not on the plane. Therefore, ribs are smashed more reliably to the extent that the contact areas are made smaller, and the sealing capability is enhanced accordingly. Also, even when a large variation takes place in the smashing margin (the degree of compression) of the sealing member 20 due to the dimensional errors of the frame member 16 and the flow path formation member 6, assembling errors, or the like, it is possible to effectuate sealing comparatively reliably with the provision of the ribs 20*a*, 20*b*, 20*c*, and 20*d*.

Particularly, with the formation of the first face-side rib 20*a* and the second face-side rib 20*c*, and the first face-side rib 20*b* and the second face-side rib 20*d* are formed symmetrically with the flat portion 20*h* of the sealing member 20 as the center between them, there is no place for pressure to escape from the frame member 16 and the flow path formation member 6, thus smashing each of the ribs 20*a*, 20*b*, 20*c*, and 20*d* reliably, to make the sealing exactness higher. Also, on both faces of the flat portion 20*h*, double ribs are formed, respectively, to make the sealing exactness higher still. In other words, even of the rib 20*a* on the outer side is not smashed completely by some causes, and it becomes impossible to secure the sealing capability only by the rib 20*a*, for example, so as not to secure the sealing capability completely, the other rib 20*b* is still able to effectuate sealing reliably. Even in a case where each of the other ribs 20*b*, 20*c*, and 20*d* is not smashed complete, the condition is the same, and the sealing capability is secured by effectuating sealing by use of the ribs other than such particular one.

As has been described above, on the circumference of the sealing member 20, plural ribs 20*a*, 20*b*, 20*c*, and 20*d* are arranged to enhance the sealing reliability significantly. For example, in such a case where rib is not completely smashed by some causes in a frequency of once in $1\times10^6$ times, the condition in which both ribs are not completely smashed simultaneously occurs in a frequency of once in $1\times10^{12}$ times if ribs are arranged in two lines. Further, if ribs are formed in three lines, the condition in which all the ribs in three lines are hot completely smashed takes place in a frequency of once in $1\times10^{18}$ times. In this manner, if the number of rib lines on the circumference is increased, the ratio of such occurrence can be reduced in involution, and the reliability can be enhanced significantly. The line arrangement of ribs should be designed appropriately in consideration of the size, function, purpose, and others needed for the liquid discharge recording head 51.

Also, for the sealing member 20, a positioning extrusion (connecting portion for use of positioning) 20*g* is provided in a position on the inner side of the inner second face-side rib 20*d* and the outer side of the hole portion 20*e*. When the frame member 16 and the flow path formation member 6 are bonded through the sealing member 20, the sealing member 20 is at first set on the flow path formation member 6, while inserting this extrusion 20*g* into a positioning hole (the portion to be connected) 6*j* of the flow path formation member 6. With the structure thus arranged, it is possible to prevent the positional deviation of the sealing member 20 due to unexpected drawback in the process to be executed. The extrusion 20*g* is arranged more inner side than the rib 20*d* that effectuates the actual sealing. Therefore, it does not affect the sealing capability. Also, with the extrusion 20*g*, the positioning of the sealing member 20 is complete only within the plane of the flat portion 20*h*. As a result, as compared with the structure in which an external reference surface or the like should be provided for the flow path formation member 6 or the like in order to position the sealing member 20, there is an advantage that it contributes to making the liquid discharge recording head 51 smaller.

In accordance with the conventional structure, the opening portion of the frame member and the supply hole of the flow path formation member are fitted, and further, the O-ring is buried tightly to seal the passage between the frame member and the flow path formation member. In accordance with the present embodiment, the sealing member 20 exists inclusively between the frame member 16 and the flow path formation member 6 to secure the sealing capability of the passage between them without enabling the opening portion 16*e* of the frame member 16 and the supply hole 6*n* of the flow path formation member 6 to be directly connected by fitting or the like. In other words, inside all the range surrounded by the ribs 20*a*, 20*b*, 20*c*, and 20*d* nipped and smashed by the lower face portion (bonding face) 16*c* of the frame member 16 and the upper face (bonding face) 6*k* of the flow path formation member 6 is sealed from the outside. Therefore, as far as the opening portion 16*e* of the frame member 16 and the supply hole 6*n* of the flow path formation member 6 are arranged within this range, no other positioning restrictions exist any longer. Likewise, there is no restriction as to the position, shape, size of the hole portion 20*e* of the sealing member 20, either. Then, although it is impossible to obtain the positioning function that results from the fitting relations among the opening portion of the frame member, the supply hole of the flow path formation member, and the O-ring, the positioning is obtained by means of the extrusion 20*g* and the positioning hole 6*j* instead as described earlier. The ribs 20*a*, 20*b*, 20*c*, and 20*d*, that effectuate actual sealing are present in the positions where these are nipped and smashed by the lower portion (bonding face) 16*c* of the frame member 16 and the upper portion (bonding face) 6*k* of the flow path formation member 6, and if only the opening portion of the frame member 16 and the supply hole of the flow path formation member 6 should be positioned within the inner side ribs 20*b* and 20*d*, there is no other restriction. Therefore, the dimensional precision of each part, the positioning precision, and the assembling precision are significantly eased as compared with the conventional art. If only the sealing member 20 should be nipped in when the frame member 16 and the flow path formation member 6 are assembled. As a result, the production process is simplified, and the required steps are made even simpler than the case where sealant or bonding agent is used. Thus, the manufacture is extremely easy to be able to attempt making the time required for manufacturer shorter while reducing the costs of manufacture, as well as curtailing the generation of defective products. Also, under the circumstances, each part can be designed with a wider freedom. Therefore, as described earlier, it is possible to provide the frame member 16 with the opening portion 16e having the same sectional area as the sectional area of the recording liquid storing chamber 17, thus obtaining various effects. Further, no bonding agent is used, and the product is preferably suitable for the process of recycling or the like, because the used product can be dismantled with ease.

In his respect, as shown in FIG. 12 and FIG. 13, the positioning hole 6*j* is provided for the flow path formation member 6, and the extrusion 20*g* that faces the hole is formed for the sealing member 20 in accordance with the present embodiment. However, the structure may be arranged so that the positioning hole is formed for the frame member 16, and the extrusion that faces the hole is formed for the sealing member 20. Further, it may be possible to provide the positioning holes both for the flow path formation member 6 and the frame member 16, and extrusions are formed on both sides of sealing member 20 to face them, respectively. Whether the sealing member 20 is positioned to the flow path formation member 6 or to the frame member 16 may be decided appropriately.

In accordance with the present embodiment, a substantially rectangular sealing member 20 is used, but the present invention is not necessarily limited to the rectangle. A polygon, a circle, an oblong or further, more complicated shape may be adoptable corresponding to the configurations of the frame member 16 and the flow path formation member 6. Also, the hole portion 20*e* of the sealing member 20 may be in the form of circle, polygon, or any others as shown in FIG. 15 and FIGS. 16A and 16B.

As has been described above, in accordance with the present invention, it is made possible to effectuate the effective distribution of recording liquid with the high sealing capability by the provision of the connecting structure formed by the opening portion 16*e* having the same sectional area as the sectional area of the recording liquid storing chamber 17 of the frame member 16; the sealing member 20 having the outer shape essentially equal to the frame member 16, which is provided with ribs 20*a*, 20*b*, 20*c*, and 20*d*, and the extrusion 20*g* as well; and the supply hole 6*n* formed arbitrarily for the flow path formation member 6 without almost any restrictions as to the position, size, shape, and others. Then, in accordance with the liquid discharge recording head 51 provided with this connecting structure, recording liquid stored in the recording liquid storing chamber 17 of the frame member 16 is supplied to the head chip 15, and supplied to the nozzle portion of the recording element base plate 1 through the recording liquid supply port 1*a* of the recording element base plate 1 by way of the filter 7 to the flow path formation member 6 and the first plate 2. Then, with the recording element being driven, recording liquid is discharged to the outside as liquid droplets for recording.

In this respect, the present invention is equally applicable to the liquid discharge recording apparatus having only a single liquid discharge recording head 51 mounted on the carriage, and the liquid discharge recording apparatus having plural liquid discharge recording heads 51 mounted on the carriage.

What is claimed is:

1. A sealing member existing inclusively between two members each provided with an opening portion for sealing both of said members from the outside, while enabling said opening portions of both of said members to be communicated, comprising:

a flat portion becoming the main body of said sealing member;

a hole portion provided for said flat portion for enabling said opening portions of both of said members to be communicated; and ribs formed for both faces of said flat portion in a form of surrounding said hole portion and said opening portions of both of said members, wherein said ribs include a first face-side rib formed on one face of said flat portion, and a second face-side rib formed on the other face of said flat portion in the symmetrical position and shape of said first face-side rib with said flat portion as the center.

2. A sealing member according to claim 1, wherein said first face-side rib is provided in plural numbers, and said second face-side rib is provided in the same number as that of said first face-side ribs.

3. A sealing member according to claim 1, wherein each of said ribs is essentially rectangle, and formed to surround said opening portion.

4. A sealing member according to claim 1, wherein said rib is configured to follow the outer shape of said flat portion.

5. A sealing member according to claim 1, wherein at least on one face of said flat portion, a connecting portion for use of positioning is provided on the inner side of said rib for positioning to the member abutting against the face.

6. A connecting structure for enabling two members each provided with an opening portion to be communicated to make distribution of liquid possible, while sealing them from the outside, wherein said sealing member according to claim 1 exists inclusively between both of said members, and for the portions of both of said members facing said sealing member, connecting faces each abutting said ribs, are provided on the outer side of each of said opening portions, and said sealing member is held so as to keep said ribs in a state of being compressed between said connecting faces themselves of both of said members.

7. A connecting structure according to claim 6, wherein the portions of both of said members facing said sealing member themselves are not provided with connecting means to connect them with each other directly.

8. A connecting structure according to claim 6, wherein said opening portions of both of said members themselves are in a shapes and sizes different from each other.

9. A connecting structure according to claim 8, wherein said hole portion of said sealing member is in a shape and a size different from any one of said opening portions of both of said members.

10. A connecting structure according to claim 6, wherein at least on one face of said flat portion of said sealing member, a connecting portion for use of positioning is provided on the inner side of said ribs surrounding said opening portion;

bonding faces of both of said members on the side of the portion facing said connecting portion for use of positioning, a portion being connected is provided to engage with said connecting portion for use of positioning; and said connecting portion for use of positioning is either one of a boss and a recessed portion, and said portion being connected is the other one of them.

11. A liquid discharge recording head comprising:

a recording unit for recording by discharging liquid droplets from discharge ports; and a recording liquid storing unit connected with said recording unit for supplying recording liquid, wherein said recording unit is provided with a supply hole serving as an opening portion for supplying recording liquid, and said recording liquid storing unit is provided with a recording liquid storing chamber having one side portion serving as an opening portion, and a bonding face having said supply hole of said recording liquid storing unit formed therefor by penetrating the face, and the bonding face positioned on said opening portion of said recording liquid storing unit are bonded through a sealing member according to claim 1, and said sealing member is held in a state having said ribs nipped and compressed between said bonding face of said recording unit and said bonding face of said recording liquid storing unit.

12. A liquid discharge recording head according to claim 11, wherein said opening portion of said recording liquid storing unit is one side portion of said recording liquid storing chamber totally opening to the outside, and a shape of said opening portion is equal to a sectional shape of said recording liquid storing chamber.

13. A liquid discharge recording head according to claim 12, wherein the frame member having said recording liquid storing chamber therefor, and serving as the principal part of said recording liquid storing unit is formed by a single member.

14. A liquid discharge recording head according to claim 12, wherein said recording unit is provided with a supply tube having said supply hole formed therefor by penetrating said bonding face of said recording unit, and a outer shape of said supply tube is smaller than said opening portion of said recording liquid storing unit and the hole portion of said sealing member, and said supply tube is inserted, not tightly but with a gap, into said opening portion of said recording liquid storing chamber and the hole portion of said sealing member.

15. A liquid discharge recording head according to claim 11, wherein a filer is arranged for said supply hole to remove mixed particles in recording liquid.

16. A liquid discharge recording head according to claim 11, wherein at least on one face of said flat portion of said sealing member, a connecting portion for use of positioning is provided on the inner side of said ribs surrounding each of said opening portions;

of said bonding faces of both of said members on the side of the portion facing said connecting portion for use of positioning, a portion being connected is provided to engage with said connecting portion for use of positioning; and said connecting portion for use of positioning is either one of a boss and a recessed portion, and said portion being connected is the other one of them.

17. A liquid discharge recording head according to claim 11, wherein said recording unit is provided with a recording element base plate having plural recording elements arranged therefor, and a flow path formation member for supply recording liquid to said recording element base plate, and said bonding face with said recording liquid storing unit and said supply hole are arranged for said flow path formation member.

* * * * *

UNITED STATES PATENT AND TRADEMARK OFFICE

CERTIFICATE OF CORRECTION

PATENT NO. : 6,808,256 B2
DATED : October 26, 2004
INVENTOR(S) : Mikiya Umeyama et al.

It is certified that error appears in the above-identified patent and that said Letters Patent is hereby corrected as shown below:

Title page,
Item [56], References Cited, U.S. PATENT DOCUMENTS, the following should also be listed:

| | | | |
|---|---|---|---|
| -- 4,349,122 | 9/1982 | Kiar, et al ……. | 220/373 |
| 5,145,219 | 9/1982 | Babuder……. | 285/330 |
| 6,000,789 | 12/1999 | Takagi, et al…… | 347/86 |
| 6,015,209 | 1/2000 | Barinaga, et al……. | 347/86 |
| 2002/180845 | 12/2002 | Barinaga, et al……. | 347/86 --. |

The following should also be listed:

-- FOREIGN PATENT DOCUMENTS

| | | |
|---|---|---|
| EP | 1,065,061 | 1/2001 |
| EP | 1,147,903 | 10/2003 |
| WO | 02/28645 | 4/2002 --. |

Column 4,
Line 28, “take place take place” should read -- take place --.

Column 7,
Line 61, “be” should be deleted; and
Line 66, “sorter” should read -- shorter --.

Column 10,
Line 18, “vies” should read -- views --.

Column 14,
Line 20, “main” should read -- main body --.

Column 15,
Line 5, “the half” should read -- the bonding portion. Along with this, the numbers of half --.

Column 17,
Line 30, “hot” should read -- not --.

Column 18,
Line 48, “his” should read -- this --.

UNITED STATES PATENT AND TRADEMARK OFFICE

CERTIFICATE OF CORRECTION

PATENT NO. : 6,808,256 B2
DATED : October 26, 2004
INVENTOR(S) : Mikiya Umeyama et al.

It is certified that error appears in the above-identified patent and that said Letters Patent is hereby corrected as shown below:

Column 20,
Line 19, “a” should be deleted.

Column 21,
Line 4, “a” should read -- an --; and
Line 12, “filer” should read -- filter --.

Signed and Sealed this

Thirtieth Day of August, 2005

JON W. DUDAS
*Director of the United States Patent and Trademark Office*